US006860662B2

(12) United States Patent
Iwamura

(10) Patent No.: US 6,860,662 B2
(45) Date of Patent: Mar. 1, 2005

(54) PRINTING APPARATUS AND METHOD FOR PROCESSING A PREDETERMINED LOCATION ON A PRINTED SHEET AND A DRIVER PROGRAM THEREFOR

(75) Inventor: Katsutoshi Iwamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 10/108,440

(22) Filed: Mar. 29, 2002

(65) Prior Publication Data

US 2002/0172539 A1 Nov. 21, 2002

(30) Foreign Application Priority Data

Mar. 30, 2001 (JP) ..... P2001-098743
Jun. 25, 2001 (JP) ..... P2001-191601

(51) Int. Cl.[7] ..... B41J 11/44
(52) U.S. Cl. ..... 400/582; 400/579
(58) Field of Search ..... 400/582, 579, 400/621

(56) References Cited

U.S. PATENT DOCUMENTS 5,490,735 A * 2/1996 Brandenburg et al. ..... 400/614
6,056,460 A * 5/2000 Suzuki ..... 400/621
6,190,066 B1 * 2/2001 Ishigouoka et al. .... 400/120.01
6,276,851 B1 * 8/2001 Kurashina ..... 400/615.2
2001/0019352 A1 * 9/2001 Miyazaki ..... 347/218

FOREIGN PATENT DOCUMENTS

JP 58145478 A * 8/1983 ..... B41J/11/70
JP 58145480 A * 8/1983 ..... B41J/11/70
JP 11-254772 9/1999

* cited by examiner

*Primary Examiner*—Charles H. Nolan, Jr.
(74) *Attorney, Agent, or Firm*—Mattingly, Stanger & Malur, P.C.

(57) ABSTRACT

When a sheet feeding/processing control part judges that when a sheet feed request of feeding a sheet by a sheet feed amount is present, an actual cutting position passes a cutter, it divides the requested sheet feed amount into first and second sheet feed amounts. To start, a sheet is fed by the first sheet feed amount, so that an actual cutting position just reaches the cutter. In a state that the sheet stops, a cutter motor is driven to operate the cutter and to cut the sheet at the cutting position. After the sheet is cut, a sheet feed motor is driven to feed the sheet by the second sheet feed amount. Also in feeding the sheet by the second sheet feed amount, a similar process is executed.

28 Claims, 8 Drawing Sheets

PRINTING APPARATUS AND METHOD FOR PROCESSING A PREDETERMINED LOCATION ON A PRINTED SHEET AND A DRIVER PROGRAM THEREFOR

BACKGROUND OF THE INVENTION

1. Field of the Invention

The present invention relates to a printer having a processing device capable of processing a predetermined location on a printed sheet, a driver program, a print system, a printing method, and a processing method.

2. Description of the Related Art

A printer which uses a roll sheet for a sheet of paper used for printing is known. The operation of printing on the roll sheet is continuously performed, and the resultant or printed sheet is long and consists of a succession of printed areas. Accordingly, the printed roll sheet must be cut at predetermined positions.

A printer which, at the completion of the printing operation, feeds a printed roll sheet to a position where a person can cut the final end position of the print, is known. The printer judges the final end position of the print on the basis of layout data (e.g., page length, top margin, bottom margin, etc.,) of a page, which is preset by a user, and drives the paper feed motor to feed the roll sheet to a position where a prestored person readily cuts the roll sheet at the final end position of the print. In this case, the final cutting of the roll sheet is manually performed, and a further cutting of the sheet having cut at the final end position into smaller parts is also manually performed.

The printing head prints while the carriage with the printing head mounted thereon reciprocatively moves in the main scan direction. A printer in which the carriage is provided with the cutter, and the sheet is cut when the carriage is moved, is also known. This type of printing device also cuts the roll sheet at the final end position of print after the completion of the printing operation.

The conventional printer is able to cut the roll sheet at the final end position of the final page printed on the sheet. Manual work must be used to further cut a long sheet having several pages printed thereon into smaller parts of those pages, however. An alternative measure to be taken for effecting such a cutting is to set up successive steps of cutting process by locating a cutting device in an upstream step of the printer. In this case, the user must install equipment, e.g., cutting device, additionally.

A request of another process, e.g., a folding process, also exists, in addition to the cutting process. Decorative paper to be set in a case of a music CD, MD. floppy disc, is inserted into the case, while folded. Accordingly, in printing on this type of decorative paper, it is efficient to fold the paper during the printing process. It is a common practice to use devices additionally prepared for those process steps.

If the printing operation is interrupted for the execution of the cutting or folding process, print quality deterioration occurs since a stripe will be formed at the interrupted location. To avoid this, it is required that a time taken for the interruption of the printing operation for processing the printed sheet is as short as possible. In the work of making the printed sheet run back and then processing the printed sheet, the printed sheet sometimes is rubbed with something, possibly deteriorating the quality of the print image on the printed sheet.

In automatizing the processing of the printed sheet, it is necessary to set a position on the sheet to which the sheet processing is to be applied, or a processing position on the printed sheet. So far as we know, there is neither the printer capable of setting the processing position on the printed sheet for each print unit nor the host computer for sending data to the printer, which has such a setting function.

SUMMARY OF THE INVENTION

For the above background reasons, a first object of the present invention is to provide a printer in which a printed sheet is subjected to a predetermined process, such as the cutting process and the folding process, during the feeding of the printed sheet in the sheet feeding direction, and the predetermined process, such as the cutting process and the folding process, is efficiently carried out for the printed sheet since the printed sheet is not moved back, a driver program, a print system, a printing method and a processing method.

Another object of the invention is to assist a person in setting an imaginary line along which a process is to be executed for a printed sheet, which the imaginary line is necessary to automatize the work of applying a predetermined process to a printed sheet.

To achieve the first object, there is provided a printer having printing means for printing on a sheet by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the processing is carried out, the improvement being characterized in that when the sheet is fed by a predetermined sheet feed amount in order to print successively incoming data, at the instant that an imaginary line on the sheet reaches a processing position, the control means 1) stops the movement of the sheet, 2) ceases the printing operation of the successively incoming data, and 3) causes the processing means to process the sheet along the imaginary line on the sheet. The term "an imaginary line on the sheet" means a position on the sheet where the processing means applies a process to the sheet. The "imaginary line on the sheet" is a position on the sheet which is processed by the processing means. Therefore, if a plurality of positions on the sheet as desired to be processed are present, then presence of a plurality of imaginary lines creates no problem. Further, the term "the sheet" is not limited to a sheet of paper. Any type of printing medium, such as a plastic film or sheet, and a metallic film or sheet may be used. The same applies to the descriptions of the present invention.

In the invention, when the sheet is fed by a predetermined sheet feed amount to print successively incoming data, the transporting means is controlled so as to stop the movement of the sheet at the instant that an imaginary line on the sheet reaches a processing position of the processing means. After the printing operation of the successively incoming data is ceased, the processing means is controlled so as to apply a process on the sheet along the imaginary line on the sheet. Accordingly, the process is carried out along the imaginary line on the sheet by feeding the sheet in the sheet feeding direction for the printing without moving back in the reverse direction. Therefore, when the work to process the sheet is additionally performed, the time taken for printing is not so long. In addition, since the sheet is not moved back when the sheet is processed, the printing interruptive time is relatively short. For this reason, printing irregularity which may occur when the print interruptive time is long will hardly occur. Where the sheet is moved back and processed, and then fed again in the sheet feeding direction again, the sheet position is minutely displaced by the backlash (play) of the gear or the like, which transmits the drive force of the transporting means, causes the sheet to be slightly shifted of its position. This will deteriorate the printing accuracy. Since the sheet is not moved back, the printer is free from the printing irregularity caused by the backlash.

In a preferred embodiment of the printer of the invention, when the sheet is fed by a predetermined sheet feed amount in order to print successively incoming data, the control means judges whether or not the imaginary line on the sheet will move beyond a processing position of the processing means, when the imaginary line will go beyond the processing position, the control means carries out a computing process to divide the sheet feed amount into first and second sheet feed amounts so that the sheet stops at the instant that the imaginary line on the sheet reaches the processing position of the processing means, and executes a sheet transportation of the first sheet feed amount prior to a sheet transportation of the second sheet feed amount, and stops the movement of the sheet at a point where the imaginary line reaches the processing position.

The embodiment, which operates as in the above-mentioned embodiment, further operates as follows. When the sheet is fed by a predetermined sheet feed amount in order to print successively incoming data, the control means judges whether or not the imaginary line on the sheet will move beyond a processing position of the processing means. If the imaginary line will go beyond the processing position, the control means carries out a computing process to divide the sheet feed amount into first and second sheet feed amounts so that the sheet stops, at the instant that the imaginary line on the sheet reaches the processing position of the processing means. A sheet transportation of the first sheet feed amount is executed prior to a sheet transportation of the second sheet feed amount, and the sheet stops its movement of the sheet at a point where the imaginary line reaches the processing position.

In another preferred embodiment of the printer, the control means causes the transporting means to execute the sheet transportation of the second sheet feed amount after the processing means processes the sheet along the imaginary line on the sheet, and restarts the printing of the successively incoming data.

In the embodiment, the transporting means executes the sheet transportation of the second sheet feed amount after the processing means processes the sheet along the imaginary line on the sheet, and then the printing of the successively incoming data is restarted.

In yet another preferred embodiment of the invention, the imaginary line on the sheet is based on any of a sheet size as set, a printed area on the sheet, and designation by a user.

According to still another embodiment of the invention, the imaginary line on the sheet is based on any of a sheet size as set, a printed area on the sheet, and designation by a user.

In a further preferred embodiment of the printer, the process is any of processes of cutting the sheet, folding the sheet, and forming perforations in the sheet.

According to an additional preferred embodiment of the invention, the process is any of processes of cutting the sheet, folding the sheet, and forming perforations in the sheet.

To achieve the first object, there is provided a driver program for issuing such commands as to cause a printer to alternately perform a sheet transporting operation and a printing execution, to stop the sheet movement upon occasion, and to carry out the process, the printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, the improvement being characterized in that when the sheet is fed by a predetermined sheet feed amount in order to print successively incoming data, the driver program causes a computer to execute the following steps of:

judging whether or not the imaginary line on the sheet will move beyond a processing position of the processing means, carrying out, when the imaginary line will go beyond the processing position, a computing process to divide the sheet feed amount into first and second sheet feed amounts so that the sheet stops at a position where the imaginary line on the sheet reaches the processing position, and issuing a first command to execute a sheet transportation of the first sheet feed amount and a second command to execute a sheet transportation of said second sheet feed amount.

In the invention, the computer executes the driver program to thereby issue such commands as to cause a printer to alternately perform a sheet transporting operation and a printing execution, and to stop, upon occasion, the sheet movement and to carry out the process. When the sheet is fed by a predetermined sheet feed amount to print successively incoming data, the computer judges, under control of the driver program, whether or not the imaginary line on the sheet will move beyond a processing position of the processing means. When the imaginary line will go beyond the processing position, the computer executes a computing process to divide the sheet feed amount into first and second sheet feed amounts so that the sheet stops at a position where the imaginary line on the sheet reaches the processing position, and issues a first command to execute a sheet transportation of the first sheet feed amount, in advance.

In a preferred embodiment, the driver program issues to said computer said second command after the first command is issued.

In the invention, the computer executes the driver program to instruct the processing means to apply a process on the sheet along the imaginary line on the sheet, and then instructs the computer to issue a second command to cause the transporting means to execute a sheet transportation of the second sheet feed amount after the first command is issued.

To achieve the first object, there is provided a print system including a host computer and a printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the process is carried out, the improvement being characterized in that when the sheet is fed by a predetermined sheet feed amount in order to print successively incoming data, the control means judges whether or not the imaginary line on the sheet will move beyond a processing position of the processing means, when the imaginary line will go beyond the processing position, the control means carries out a process of dividing the sheet feed amount into first and second sheet feed amounts so that the sheet stops at a position where the imaginary line on the sheet reaches the processing position, and the control means causes the transporting means to execute a sheet transportation by a first sheet feed amount, and ceases the printing operation of the successively incoming data, and causes the processing means to process the sheet along the imaginary line on the sheet.

In the invention, when the sheet is fed by a predetermined sheet feed amount to print successively incoming data, the control means judges whether or not the imaginary line on the sheet will move beyond a processing position of the processing means. When the imaginary line will go beyond the processing position, a process of dividing the sheet feed amount into first and second sheet feed amounts is carried out so that the sheet stops at a position where the imaginary line on the sheet reaches the processing position. Subsequently, the transporting means executes a sheet transportation by a first sheet feed amount, and after the printing operation of the successively incoming data is ceased, the processing means is controlled so as to process the sheet along the imaginary line on the sheet.

In a preferred embodiment of the print system, the sheet feed amount dividing process is executed in the printer.

In this print system, the sheet feed amount dividing process is executed in the printer.

In another preferred embodiment of the print system, the sheet feed amount dividing process is executed in the host computer.

In the print system, the sheet feed amount dividing process is executed in the host computer.

To achieve the first object, there is provided a printing method for a printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the process is carried out, the improvement being characterized in that the printing method comprises the steps of:

judging whether or not the imaginary line on the sheet will move beyond a processing position of the processing means when the sheet is fed by a predetermined sheet feed amount in order to print successively incoming data:

carrying out a process of dividing the sheet feed amount into first and second sheet feed amounts so that the sheet stops at a position where the imaginary line on the sheet reaches the processing position, when the imaginary line will go beyond the processing position, executing a sheet transportation of the first sheet feed amount prior to a sheet transportation of the second sheet feed amount, and ceasing the printing operation of the successively incoming data, and causing the processing means to process the sheet along the imaginary line on the sheet.

According to the invention, when the sheet is fed by a predetermined sheet feed amount to print successively incoming data, judgement is made as to whether or not the imaginary line on the sheet will move beyond a processing position of the processing means. When the imaginary line will go beyond the processing position, a process of dividing the sheet feed amount into first and second sheet feed amounts is carried out so that the sheet stops at a position where the imaginary line on the sheet reaches the processing position. A sheet transportation of the first sheet feed amount is executed prior to a sheet transportation of the second sheet feed amount. After the printing operation of the successively incoming data is ceased, the processing means processes the sheet along the imaginary line on the sheet.

To achieve the first object, there is provided a processing method of processing a driver program which issues commands to a printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the process is carried out, the improvement being characterized in that the processing method comprising the steps of:

judging whether or not the imaginary line on the sheet will move beyond a processing position of the processing means, when the transporting means is caused to feed the sheet by a predetermined sheet feed amount in order to print successively incoming data;

carrying out, when the imaginary line will go beyond the processing position, a process of dividing the sheet feed amount into first and second sheet feed amounts so that the sheet stops at a position where the imaginary line on the sheet reaches the processing position; and issuing a command to execute a sheet transportation of the first sheet feed amount prior to a command to execute a sheet transportation of the second sheet feed amount.

According to the invention, when the sheet is fed by a predetermined sheet feed amount in order to print successively incoming data, it is judged whether or not the imaginary line on the sheet will move beyond a processing position of the processing means. When the imaginary line will go beyond the processing position, a process of dividing the sheet feed amount into first and second sheet feed amounts is carried out so that the sheet stops at a position where the imaginary line on the sheet reaches the processing position. A command to execute a sheet transportation of the first sheet feed amount is issued to the printer prior to a command to execute a sheet transportation of the second sheet feed amount.

To achieve the first object, there is provided a driver program for issuing commands to a printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the process is carried out, the improvement being characterized in that the driver program causes a computer to serve as means for judging whether or not the imaginary line on the sheet will move beyond a processing position of the processing means, when the transporting means is caused to feed the sheet by a predetermined sheet feed amount in order to print successively incoming data, means for carrying out, when the imaginary line will go beyond the processing position, a process of dividing the sheet feed amount into first and second sheet feed amounts so that the sheet stops at a position where the imaginary line on the sheet reaches the processing position; and means for issuing a command to execute a sheet transportation of the first sheet feed amount prior to a command to execute a sheet transportation of the second sheet feed amount.

According to the invention, the computer executes the driver program. When the sheet is fed by a predetermined sheet feed amount in order to print successively incoming data, judgement is made as to whether or not the imaginary line on the sheet will move beyond a processing position of the processing means. When the imaginary line will go beyond the processing position, a process of dividing the sheet feed amount into first and second sheet feed amounts is carried out so that the sheet stops at a position where the imaginary line on the sheet reaches the processing position. A command to execute a sheet transportation of the first sheet feed amount is issued to the printer prior to a command to execute a sheet transportation of the second sheet feed amount.

To achieve the first and second object, there is provided a printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the process is carried out, the improvement being characterized by processing position designating means for designating a desired position on the sheet as an imaginary line.

In the invention, the printing means, the transporting means and the processing means are controlled such that a sheet transporting operation and a printing execution are alternately performed, and after the sheet movement is stopped upon occasion, the process is carried out. In addition, the processing position designating means designates a desired position on the sheet as an imaginary line.

To achieve the first object, there is provided a printer having printing means for printing on a sheet of paper by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the process is carried out, the improvement being characterized in that the control means manages the imaginary line on the sheet in the terms of a logical position on the sheet as obtained based on an accumulative value of sheet transporting amount applied to the transporting means.

According to the invention, the printing means, the transporting means and the processing means are controlled such that a sheet transporting operation and a printing execution are alternately performed, and after the sheet movement is stopped upon occasion, the process is carried out. The control means manages the imaginary line on the sheet in the terms of a logical position on the sheet as obtained based on an accumulative value of sheet transporting amount applied to the transporting means.

Features and advantages of the invention will be evident from the following detailed description of the preferred embodiments described in conjunction with attached drawings.

DETAILED DESCRIPTION OF THE PREFERRED EMBODIMENTS

First embodiment

The first embodiment constructed according to the present invention will be described with reference to FIGS. 1 through 6.

Figure 4:
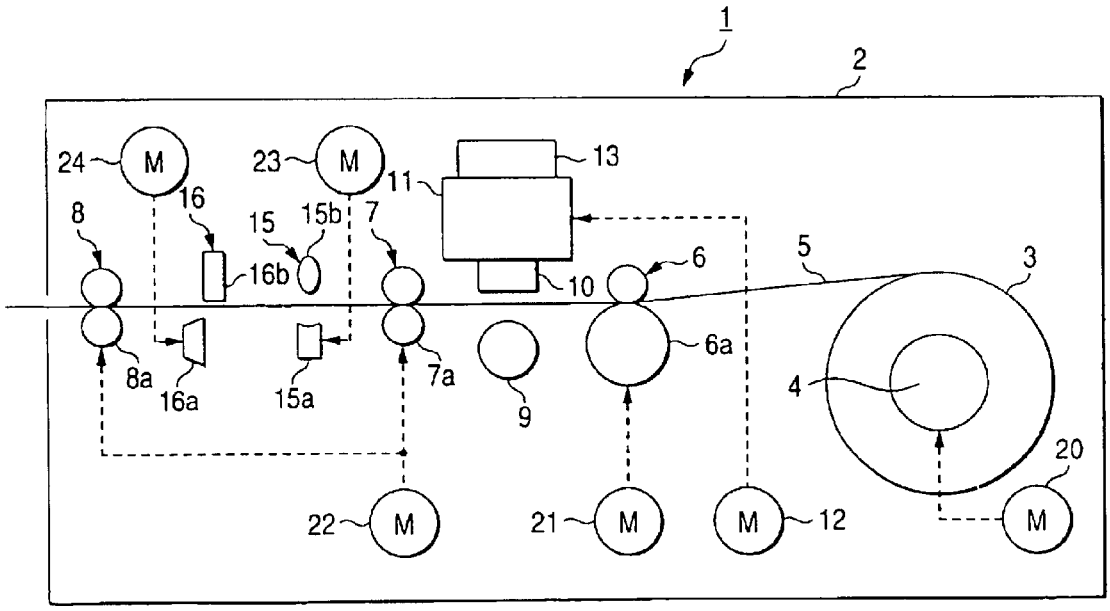
FIG. 4 is a side view showing, in a model form, a mechanism of a printer.

FIG. 4 is a diagram schematically showing a mechanism of a printer. As shown in the figure, a printer 1 as a printing device is an ink jet printer of the type which can handle a roll sheet and print on a roll sheet as continuously fed from a roll of sheet (rolled sheet) 3 loaded in a case 2. Actually, a plurality of printing units are vertically stacked one upon the other to form one printer 1. In the figure, of those printing units, one printing unit is typically illustrated.

Disposed within the case 2 are a roll sheet shaft 4 rotatably supporting the rolled sheet 3 thereon and a sheet supply roller 6, a sheet feed roller 7 and a sheet discharge roller 8, which are located at predetermined intervals along a sheet transporting path for guiding a sheet of paper (continuous form) 5 fed from the rolled sheet 3. A platen 9 is disposed between the sheet supply roller 6 and the sheet feed roller 7. A carriage 11 having a printing head 10 mounted on the bottom surface thereof is provided above the platen 9 in a state that it is reciprocatively movable in the main scan direction (the direction perpendicular to a paper surface of the figure).

The carriage 11 is driven by a carriage motor 12 to move in the main scan directions with respect to the sheet as guided to a position between the sheet supply roller 6 and the sheet feed roller 7, with the aid of a timing belt (not shown). When the carriage 11 is moved, the printing head 10 ejects ink supplied from an ink cartridge (containing color ink or black ink) 13 loaded to the carriage 11, there by printing on the upper surface of the sheet 5.

A folding device 15 and a cutter 16 as processing devices are disposed between the sheet feed roller 7 and the sheet discharge roller 8. The printing unit is designed such that during the sheet feeding between the sheet feed roller 7 and the sheet discharge roller 8, the folding device 15 performs a process of folding the sheet, and the cutter 16 performs a process of cutting the sheet. A dust box (not shown) for collecting scraps of the sheet as cut is disposed under the cutter 16.

The roll sheet shaft 4 is driven by a roll sheet motor 20 in synchronism with sheet feed timings at the time of printing. A drive roller 6*a* of the sheet supply roller 6 is driven, by a sheet supply motor 21, through a gear mechanism (not shown) A drive roller 7*a* of the sheet feed roller 7 and a drive roller 8*a* of the sheet discharge roller 8 are driven, by a sheet feed motor 22, through a gear mechanism (not shown) in a synchronizing manner. In the embodiment, the sheet feed motor 22 is a stepping motor.

The folding device 15 includes a movable edge 15*a* and a fixed edge 15*b*. The movable edge 15*a* is driven by a fold motor 23 as an actuator, and moved in the main scan direction within a range of distance long enough for it to completely cross the sheet 5 in the width direction, with the aid of a mechanism, not shown. The sheet 5 is folded through a crossing motion of the movable edge 15*a* when it crosses the sheet 5.

The cutter 16 includes a movable blade 16*a* and a fixed blade 16*b*. The movable blade 16*a* is driven by a cutter motor 24, and is moved in the main scan direction within a range of distance long enough for it to completely cross the sheet 5 in the width direction, with the aid of a mechanism, not shown. The sheet 5 is cut through a crossing motion of the fixed blade 16*b* when it crosses the sheet 5.

Figure 1:
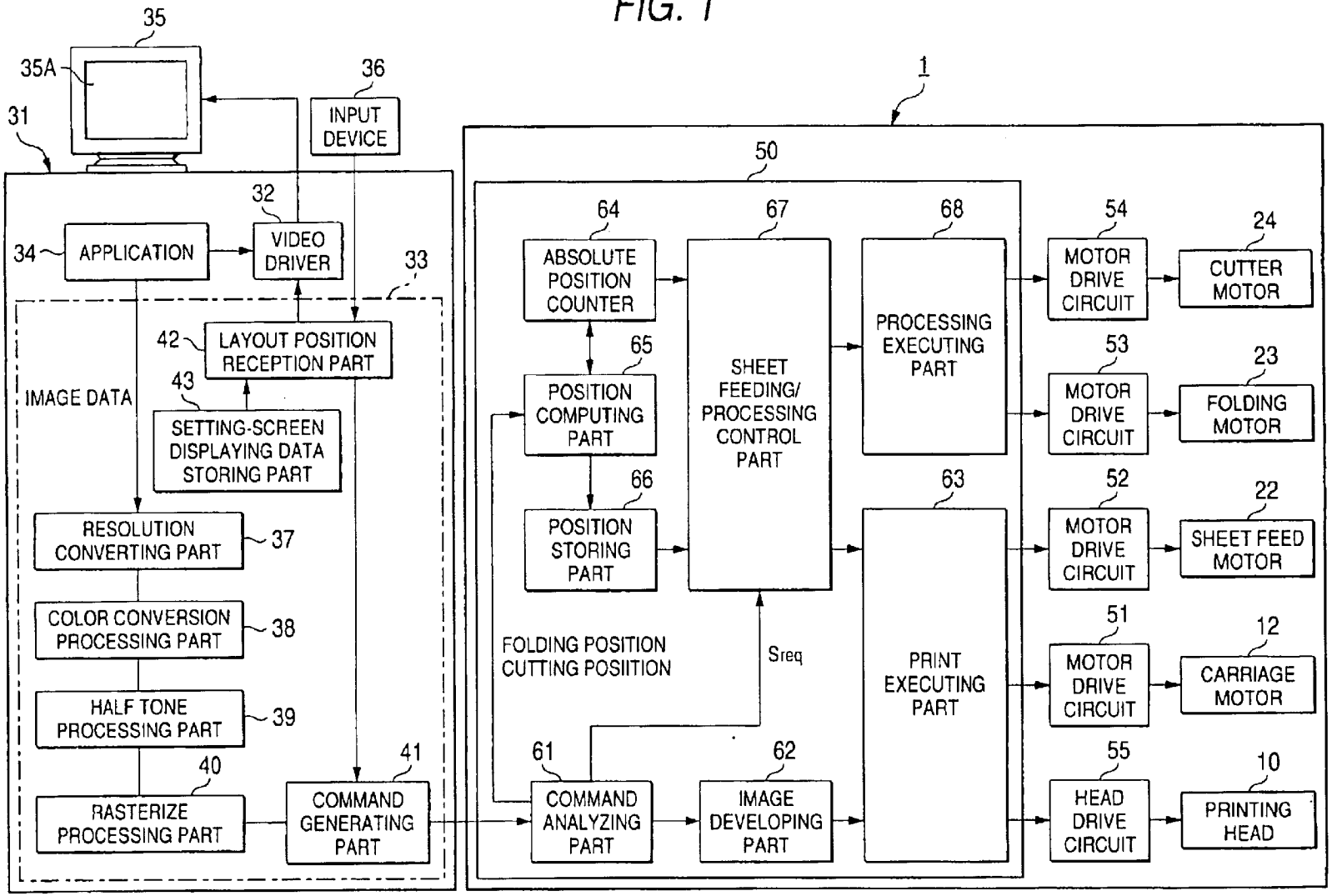
FIG. 1 is a block diagram showing a configuration of a print system which is an embodiment of the invention.

FIG. 1 is a block diagram showing a configuration of a printing system of the invention. The printing system includes the printer 1 and a host computer (PC) 31.

A video driver program and a printer driver program as a driver program are read out from a CD-ROM as a recording medium, and installed on the host computer 31. Those programs and a CPU cooperate to construct a video driver 32 and a printer driver 33 in the host computer 31. An image processing application program 34 (referred to as an application) is read out from a CD-ROM as a recording medium, and installed on the host computer 31. The application 34 is executed by the CPU to thereby carry out various processes on image data. Examples of those processes that the application 34 carries out are a process of capturing an image from a scanner or a digital camera, a process of processing image data, a process of transmitting image data to the video driver 32 and displaying an image on a screen 35A of a display device 35 and a process of transmitting image data to the printer driver 33 so as to make the printer 1 print the image displayed on the screen 35A.

For example, when a print command is input by operating an input device (a keyboard, a computer mouse or the like) 36, image data stored in a video buffer (not shown) are transmitted to the printer driver 33 and converted into print data PD, and then converted data are transferred to the printer 1. To carry out the printing processes for this, the printer driver 33 includes a resolution converting part 37, a color conversion processing part 38, a half tone processing part 39, a rasterize processing part 40 and a command generating part 41.

The resolution converting part 37 converts a resolution of the image data received from the application 34 into a printing resolution at which the printer 1 prints. The color conversion processing part 38 receives the image data from the resolution converting part 37 and carries out a color conversion process which converts the image data of RGB gradation values into the image data of CMYK gradation values, used in the printer 1. The color conversion process is executed by referring to a color conversion table (look-up table, not shown).

The half tone processing part 39 receives the CMYK image data having undergone the color conversion processing, and carries out a half tone process for converting the data into CMYK dot data of 4 gradation levels, which can be expressed by the printer 1. Three dot areas (ink ejection amounts), large, medium, small, and no dot formation are specified by the dot data of 4 gradation levels thus converted.

The rasterize processing part 40 receives dot data for each color ink dot from the half tone processing part 39, and performs an interlace process which rearranges the dot data of four gradation levels into the dot data ordered for transfer to the printer 1, while considering the dot forming order. The command generating part 41 imparts commands to the data after the interlace processing, and outputs it as print data PD. The printing data PD are transferred to the printer 1 by the packet transfer communication.

The printer driver 33 also includes a layout position reception part 42 and a setting-screen displaying data storing part 43. The setting-screen displaying data storing part 43 stores setting-screen display data (input-screen display data) The layout position reception part 42 has also a display control function. That is, when receiving a request of displaying the setting-screen by the operation of the input device 36, it reads out the setting-screen displaying data from the storing part 43, and displays a setting screen (input screen) 45 shown in FIG. 2 on the screen 35A, through the video driver 32. The setting screen 45 is used for designating a page layout by input operations. User can set a layout of a page to be printed by operating the input device 36, while watching the setting screen 45 on the screen 35A.

Figure 2:
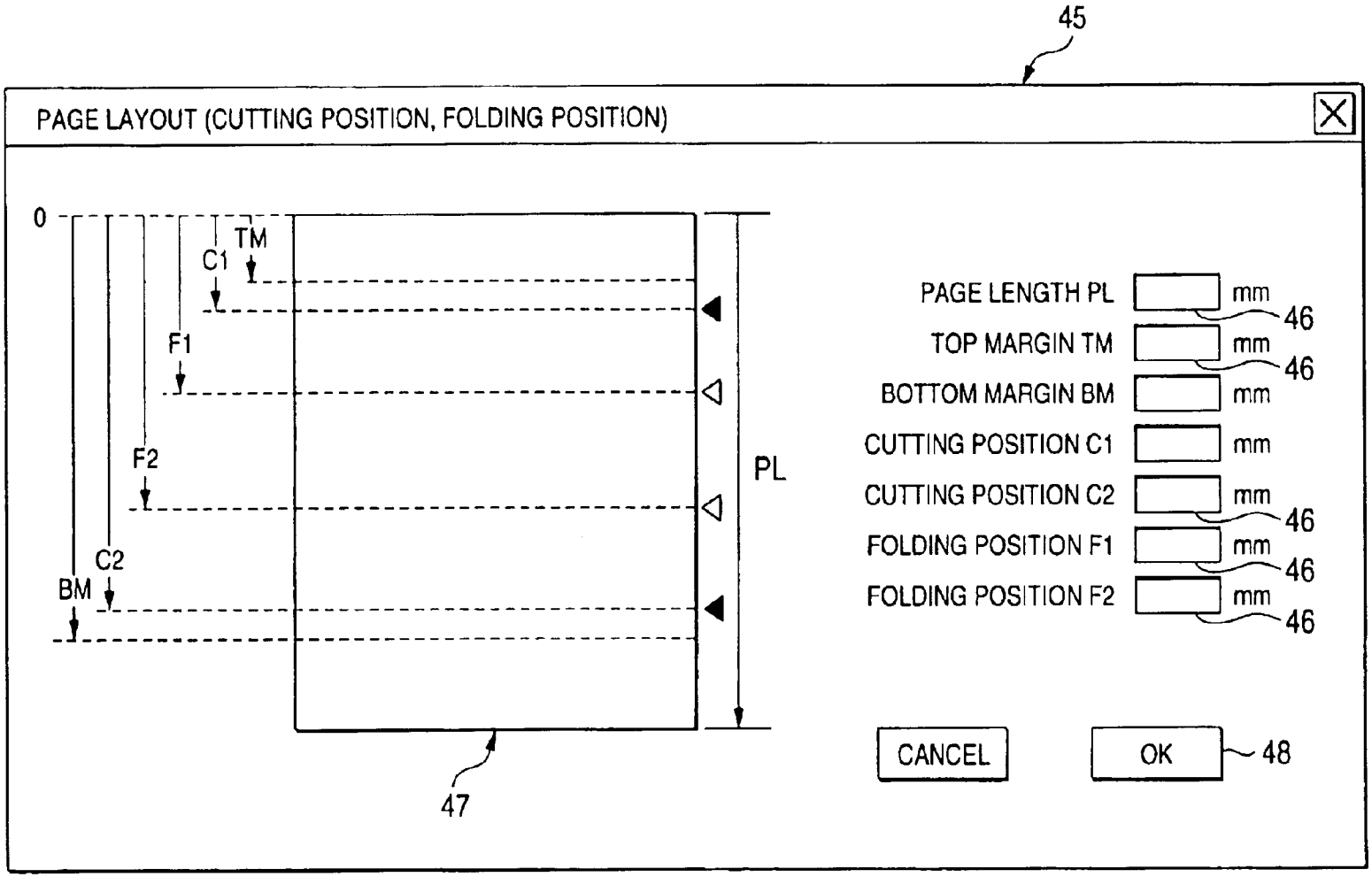
FIG. 2 is a diagram showing a setting screen for setting a page layout.
Figure 3:
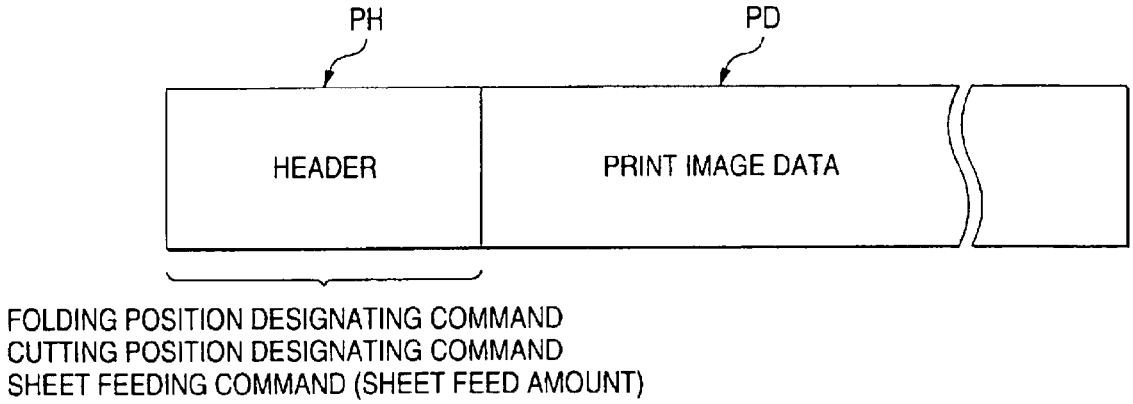
FIG. 3 is a diagram partially showing a print data format.

As shown in FIG. 2, page length PL, top margin TM, bottom margin BM, cutting positions C1 and C2, and folding positions F1 and F2 may be input, for each page, to input fields 46 on the layout setting screen 45, and specified in terms of specific values. Lines (broken lines in the figure) on a page image 47 can be vertically shifted by operating the input device 36. For example, when one of the lines is shifted by operating the computer mouse, a value corresponding to the shifted line is set to the corresponding input field 46. When a numeral value is input to one of the input fields 46 by operating the keyboard, the line as input is shifts to a corresponding position in the page image. After inputting the values of PL, TM, BM, C1, C2, F1, and F2, an OK button 48 is operated. Then, those page data PL, TM and BM and the processing-position data C1, C2, F1 and F2 are received by the layout position reception part 42. A position on the sheet where the processing device carries out a process will be referred to as "an imaginary line on the sheet". The "imaginary line on the sheet" is a position on the sheet which is processed by the processing device. Therefore, If a plurality of positions on the sheet as desired to be processed are present, then a plurality of imaginary lines exist correspondingly. Another imaginary line on the sheet that can be set on the layout setting screen 45 of FIG. 2 is a line of perforations. When a perforation processing device (not shown) is installed in the printer 1, the imaginary line of the perforations may be layout set. Accordingly, in the embodiment, cutting positions C1 and C2, folding positions F1 and F2 and the line of perforations correspond to the imaginary lines on the sheet.

A unit area (normally one page) corresponding to a minimum page image 47 necessary for setting the layout corresponds to a print unit. A print image (not shown) is also displayed in the page image 47. The user can input and designate the processing positions C1, C2, F1, F2 and the like at desired positions on the page image 47, while checking the positions on the print image.

The command generating part 41 receives the page data of PL, TM and BM and the processing position data (the imaginary line data) of C1, C2, F1 and F2 from the layout position reception part 42, and imparts commands to a header PH of the print data PD on the basis of the received data. Specifically, a sheet feed command is imparted to the header on the basis of the page data of PL, TM and BM. The sheet feed command designates a sheet feed instruction and an amount of the sheet feeding. A cutting position designate command is imparted to the header PH of the print data PD on the basis of the cutting position data C1 and C2 as processing position data. A folding position designating command is imparted to the header PH of the print data PD on the basis of the folding position data F1 and F2 as processing position data. The processing position command and the folding position command (perforation command) correspond to imaginary line designate data.

The printer 1 includes a control part 50, the motors 12, 22 to 24, the printing head 10, motor drive circuits 51 to 54 and a head drive circuit 55, which are provided for driving and controlling the printing head 10 and the motors 12, 22 to 24.

The control part 50 includes a command analyzing part 61, an image developing part 62, a print executing part 63, an absolute position counter 64, a position computing part 65, a position storing part 66, a sheet feeding/processing control part 67 and a processing executing part 68. The control means is made up of the print executing part 63, sheet feeding/processing control part 67, the processing executing part 68 and the motor drive circuits 52 to 54.

The command analyzing part 61 analyzes the commands imparted to the header PH of the print data PD. When the cutting position designate command or the folding position designate command is present in the header PH, the command analyzing part analyzes the command and acquires a cutting position C or a folding position F, which is given as a relative position on the page. The command analyzing part 61 also analyzes the sheet feed command to acquire a sheet feed amount Sreq. Those data of the cutting position C, folding position F and sheet feed amount Sreq, which are acquired through the analyzing, are transmitted to the position computing part 65. The print data having undergone the command analysis are transferred to the image developing part 62.

The image developing part 62 develops the data as received. The developed data are transmitted to the print executing part 63. The print executing part 63 controls the printing head 10 on the basis of the image-developed data so that it ejects an ink drop of a given color in a predetermined dot pattern.

The print executing part 63 drives and controls the carriage motor 12 through the motor drive circuit 51 to reciprocatively move the carriage motor 12 in the main scan directions to print. The print executing part 63 also drives and controls the sheet feed motor 22 through the motor drive circuit 52 so that when the sheet feed is required, the sheet 5 is fed by a predetermined sheet feed amount. The print executing part 63 instructs the number of steps to drive the sheet feed motor 22 to the motor drive circuit 52. The sheet feed amount is based on a sheet feed amount as instructed by the sheet feeding/processing control part 67.

The absolute position counter (referred to as a position counter) 64 is, for example, a 4-byte counter, and is reset when the power source of the printer 1 is turned on, and then starts to count the steps of the sheet feed motor 22. In the embodiment, a predetermined reference position (head position) of the printing head 10 is managed based on the counter value of the position counter 64. The current printing position (recording position) on the sheet is managed based on the counter value of the printing head position. More exactly, the position counter 64 is reset when the power source of the printer 1 is turned on. In turn, the leading end of the supplied sheet 5 is detected by a sheet detect sensor (not shown), and the sheet is fed from that position by a predetermined number of steps to register the sheet 5. The counter value of the position counter 64 at that time is used as the present head position. For example, when a counter value at the time of sheet head registering completion is "1000", the present head position (printing position), which is attained after the sheet is fed from the registered position by a predetermined number of steps (e.g., "200" in terms of count value), is "1200". In this way, the position counter 64 continues the operation of adding the number of drive steps of the sheet feed motor 22 so long as the power source of the printer 1 is not turned off. When the sheet head is registered again as the result of roll sheet replacement, the print executing part acquires a new a count value representing the head position from the absolute position counter 64. Thus, the present head position (present printing position) is managed in terms of absolute position by a counter value (accumulative value) of the position counter 64. A logical position on the sheet may be specified as a unique address by using a counter value of the position counter 64. Accordingly, a position on a portion, not yet supplied, of a long sheet, e.g., roll sheet, may be designated as a logical position on the sheet. The position counter 64 may continue the operation of adding the number of driving steps irrespective of the on and off of the power source.

The position computing part 65 executes a computing process of converting a cutting position C, expressed in terms of relative position, which is received from the command analyzing part 61, into a cut position AC expressed in terms of an absolute position. Further, it executes a computing process of converting a fold position F expressed in terms of a relative position into a fold position AF expressed in terms of an absolute position. Print data of pages, not yet printed, which comes from the printer 1, has been stored in a receiving buffer (not shown). The position computing part 65 has recognized relative positions of the cutting position C and the folding position F to the present printing position (head position) on the basis of command information of the print data stored in the receiving buffer. The present printing position (absolute position) Ppre may be known from the count value of the absolute position counter 64. Therefore, the position computing part computes the absolute positions AC and AF of the cutting position C and the folding position F.

In the instant embodiment, two kinds of imaginary lines AC and AF on the sheet 5 are not managed individually, but the imaginary line positions are converted into the values (absolute values) of the head positions, and those converted values are managed. To be more specific, the value of the present printing position (absolute value) Ppre as presented when the imaginary cut line on the sheet 5 is exactly coincident with the cutter 16 is set at a cutting position P. The value of the present printing position (absolute value) Ppre as presented when the imaginary fold line on the sheet 5 is exactly coincident with the folding device 15 is set at a folding position P. Thus, all of the imaginary lines are managed in terms of the present printing position converted value Pn (n=1, 2, . . . , K and P1<P2< . . . <PK). Specifically, the cutting position is managed in terms of a value Pn (=AC−Sc) which is larger than the actual imaginary cut line AC by a distance (corresponding to a count value) Sc between the printing head 10 and the cutter 16. The folding position is managed in terms of a value Pn (=AF−Sf) which is larger than the actual imaginary fold line AF by a distance (corresponding to a count value) Sf between the printing head 10 and the folding device 15. A count value Se corresponding to a distance between the memory position of the printing head 10 and the cutter 16, and a count value Sf corresponding to a distance between a memory position of the printing head 10 and the folding device 15 are stored in a memory (storing means). By using those values Sc and Sf, the values AC and AF are converted into Pn=AC−Sc) and Pn (=AF−Sf) The subscription "n" of Pn indicates the number assigned to the processing positions before the sheet processing in an ascending order.

In the management of the cutting positions and the folding positions, their contents are not considered. The cutting position or folding position subsequent to the present position as the reference position is managed merely as a processing position P1. The cutting position or folding position subsequent to the former position is managed merely as a processing position P2. The fact that the two processing positions P1 and P2 are equal to each other (P1=P2) indicates that the imaginary cut line on the sheet 5 is coincident with the cutter 16, and the actual imaginary fold line on the sheet 5 is coincident with the folding device 15. The type of processing to be carried out at the processing position P1 or P2 (cutting operation or folding operation) is determined based on a cut command or a fold command. The position computing part 65 stores the processing position Pn computed and data representing the corresponding processing contents (cutting or folding operation) in the position storing part 66. All the processing positions Pn on the processings to be executed and a reference table used for determining the processing contents corresponding to them are stored in the position storing part 66.

Figure 5:
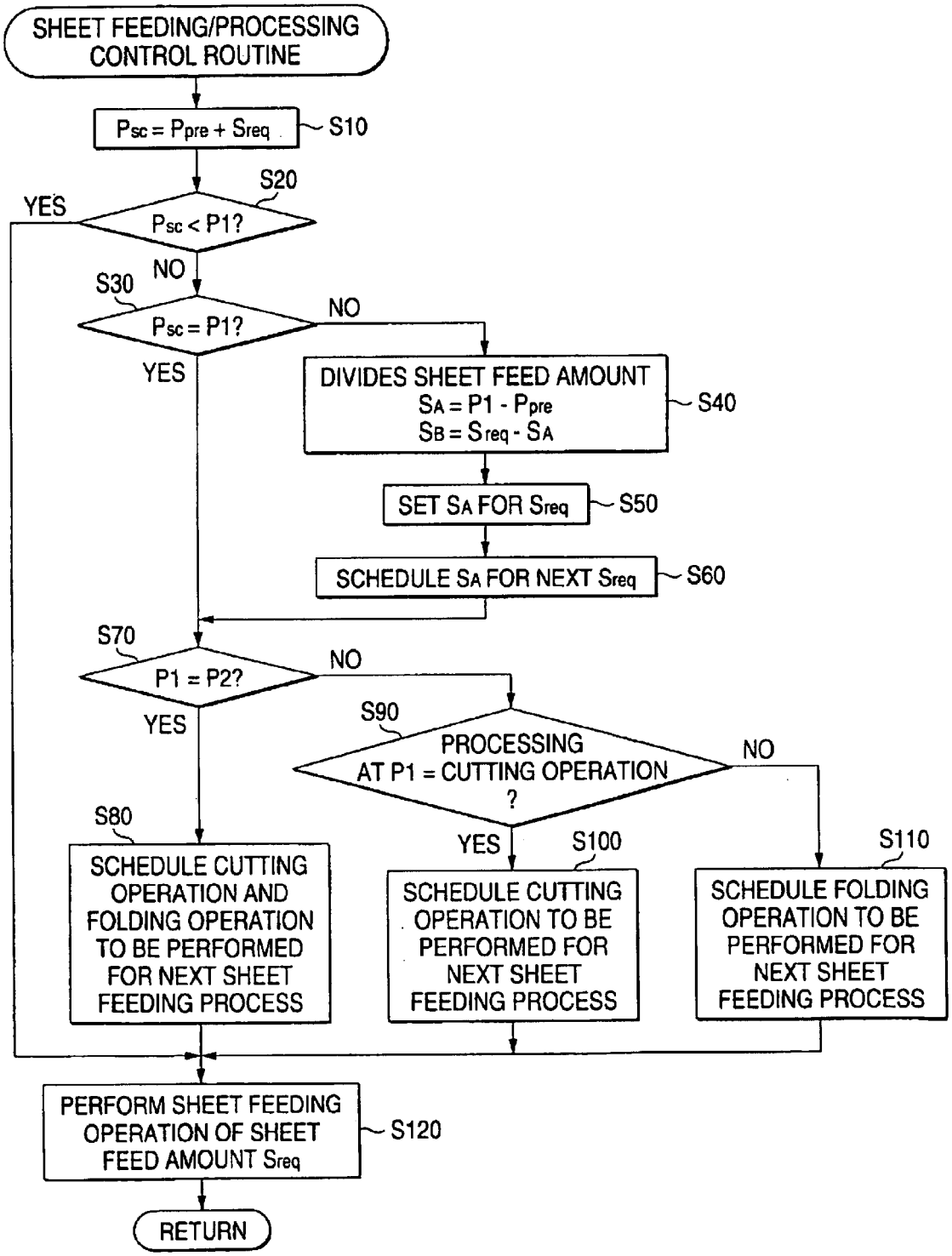
FIG. 5 is a flowchart showing a sheet-feeding/processing control routine.

A sheet feeding/processing control part 67 stores a sheet-feeding/processing control program in its storage part. A sheet-feeding/processing control routine shown in the form of a flow chart in FIG. 5 is for executing the sheet feeding control of a printed sheet 5, and a control of processing the sheet at a processing position. Before the print executing part 63 instructs the next sheet feeding, the sheet feeding/processing control part 67 executes the routine to make out a schedule of the sheet feeding control and the processing control.

Description will be given about a sheet-feeding/processing control routine of FIG. 5. The sheet feeding/processing control part 67 reads the present position (absolute position) Ppre, requested sheet feed amount Sreq, and two processing positions P1 and P2, before the routine starts in execution. A sheet feed amount having been received from the command analyzing part 61 and been managed thereby is used for the requested sheet feed amount Sreq.

In a step (denoted simply as "S1") 10, the sheet feeding/processing control part computes a position Psc=Ppre+Sreq. Exactly, it computes an absolute position Psc produced when the sheet is fed from the present position Ppre by the requested sheet feed amount Sreq.

In S20, the sheet feeding/processing control part judges whether or not Psc<P1. If the relation Psc<P1 holds, there is no chance that even if the sheet is fed by the requested sheet feed amount Sreq, the next processing position P1 will reach the corresponding processing device. Accordingly, the sheet feeding/processing control part advances to S120, and in the step, it executes the sheet feeding of the requested sheet feed amount Sreq. If Psc<P1 does not hold, the sheet feeding/processing control part 67 advances to 530.

In S30, the sheet feeding/processing control part (referred to frequently as "control") judges if Psc=P1 holds. If the relation Psc=P1 holds, when the sheet is fed by the requested sheet feed amount Sreq, the processing position P1 just reaches a corresponding processing device. Accordingly, in this case, the control advances to S70. If the relation Psc=P1 does not hold, viz., the relation is: Psc>P1, when the sheet is fed by the requested sheet feed amount Sreq, the processing position P1 passes the processing device. Therefore, the control advances to S40.

In S40, the control executes a computing process of dividing the sheet feed amount. Specifically, the control computes SA=P1−Ppre and SB=Sreq−SB, and divides the requested sheet feed amount Sreq into first and second sheet feed amounts SA and SB.

In S50, the control schedules SA to be used as Sreq.

In S60, the control schedules SB to be used as the next (Sreq).

In 570, the control judges if P1=P2. In other words, the control judges if an imaginary line and an imaginary fold line reach the processing devices 15 and 16. If P1=P2 holds, the control advances to S80. If P1=P2 does not hold, the control advances to S90.

In S80, the control schedules a cutting operation and a folding operation for the next sheet feeding process.

In S90, the control judges if the processing at the position P1 is a cutting operation. If the processing to be executed at P1 is the cutting operation, the control advances to S100. If it is not the cutting operation, the control advances to In S100, the control schedules the cutting operation of the next sheet feed processing.

In S110, the control schedules the folding operation of the next sheet feed processing.

In S120, the control executes the sheet feeding of the requested sheet feed amount Sreq. In other words, when the processing position P1 does not reach the corresponding processing device and when the processing position P1 just reaches the corresponding processing device, the sheet feeding/processing control part performs the sheet feeding of the sheet feed amount Sreq as requested. Where the sheet feeding of the requested sheet feed amount Sreq is performed, if the processing position P1 passes the corresponding processing device, the sheet feed amount SA resulting from the dividing of the requested sheet feed amount Sreq is set for a new sheet feed amount Sreq (=SA), and the sheet is fed by the new sheet feed amount. When the second sheet feed amount SB produced by dividing the requested sheet feed amount Sreq in S60 is set for the next requested sheet feed amount (Sreq), the sheet feed amount Sreq (SB) set in S60 is used in the next execution of the routine. Also in the sheet feeding of the sheet feed amount Sreq (=SB), the control judges whether or not the processing position P1 reaches the processing device or whether or not it passes the processing device, and if necessary, divides the second sheet feed amount (SB).

The sheet feeding and processing operations performed when the sheet-feeding/processing control is carried out will be described with reference to FIG. 6. Hatched areas on the sheet 5 are printed area.

Figure 6A:
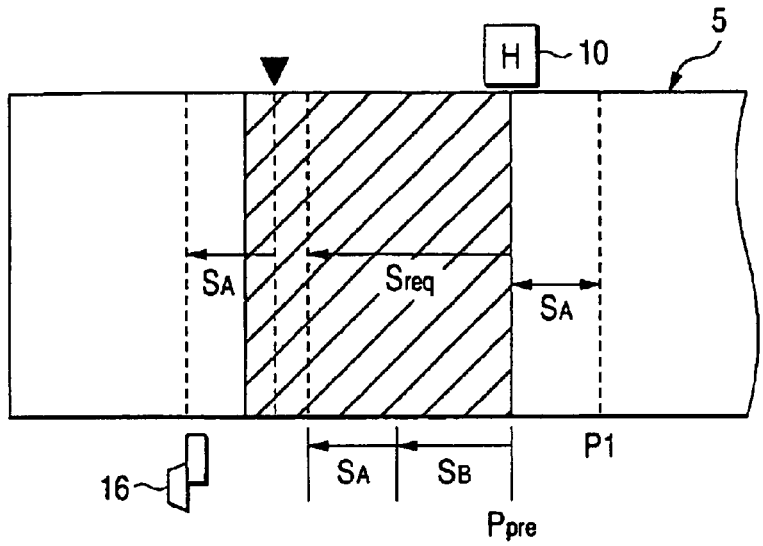
FIG. 6 is a diagram useful in explaining a sheet feeding/processing control.

It is assumed that the sheet 5 is located in a state as shown in FIG. 6A, and a sheet feeding request of the sheet feed amount Sreq is made. In this case, if the sheet is fed by the requested sheet feed amount Sreq, an imaginary cut line position (▼ position) on the sheet passes the cutter 16 (the processing position P1 passes the head position). To avoid this, the requested sheet feed amount Sreq is divided into first and second sheet feed amounts SA and SB. The first sheet feed amount SA is assumed to take a value representing a range from the processing position P1 to the present position Ppre, i.e., SA=P1−Ppre. The result SB of subtracting the first sheet feed amount SA from the requested sheet feed amount Sreq (SB (=Sreq−SA)) is used as the next requested sheet feed amount Sreq.

Figure 6B:
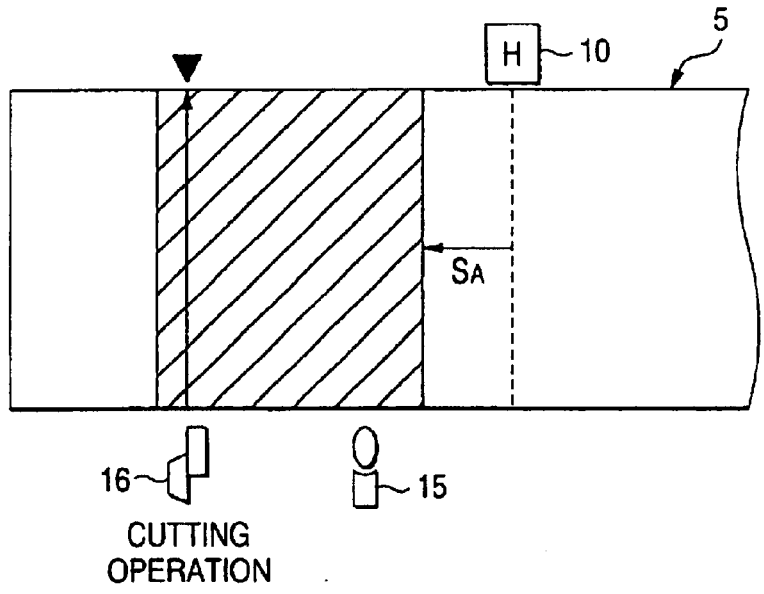

Then, the sheet 5 is fed out by the first sheet feed amount SA as shown in FIG. 6B. In turn, the imaginary cut line position (▼ position) on the sheet just reaches the cutter 16. The cutter motor 24 is driven to operate in a state that the sheet 5 is at a standstill, whereby the cutter 16 is driven to cut the sheet 5 along the imaginary cut line.

Figure 6C:
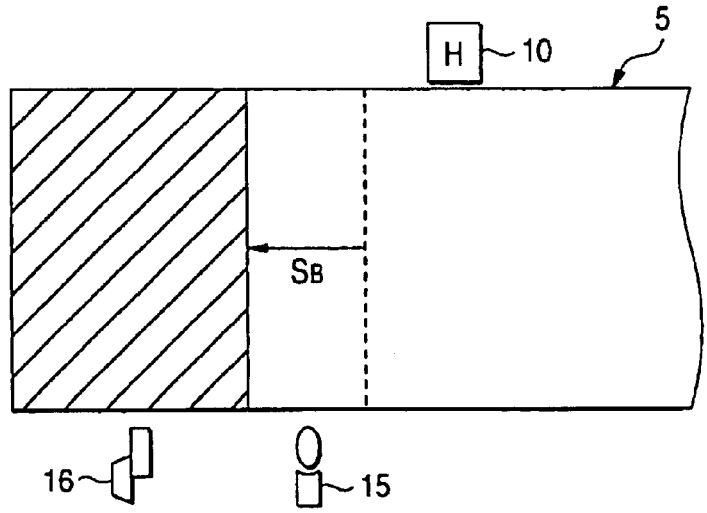

As shown in FIG. 6C, after the sheet 5 is cut, the sheet feed motor 22 is driven to feed out the sheet 5 by the second sheet feed amount SB. As a result, the initial sheet feeding operation of the requested sheet feed amount Sreq ends. The second sheet feed amount SB is used as the next requested sheet feed amount Sreq. Also in the sheet feeding of the second sheet feed amount, the control checks if the next processing position P1 takes a value indicating that the imaginary cut line passes the corresponding processing device. When it passes the processing device, the second sheet feed amount SB is further divided into two sheet feed amounts. And the sheet is fed by the divided sheet feed amount, and then the processing device is operated and the sheet 5 is processed along a predetermined imaginary line thereon. When a plurality of imaginary lines pass the corresponding processing devices during the sheet feeding of the requested sheet feed amount Sreq, the requested sheet feed amount Sreq is divided, and the sheet is processed along the plurality of imaginary lines while being successively fed a small distance. When the two processing positions P1 and P2 are of the same value, the folding device 15 and the cutter 16 are operated at the position of the same sheet 5. The folding device 15 and the cutter 16 are driven substantially at the same time. If necessary, for the operation timings of the processing devices 15 and 16, those devices may be time sequentially operated, as a matter of course.

If a print end command is contained in print data PD, the sheet feeding/processing control part 67 judges that the printing operation ends. The control sets the requested sheet feed amount Sreq so that the sheet 5 is cut at the final imaginary cut line (final processing position). A step value which corresponds to a count value equal to a distance between the final cut line and the cutter 16, i.e., a distance that a final cutting position Pend has moved till it reaches the head position is set as the requested sheet feed amount Sreq. The final processing position may be set at the end of the final page.

Also at the time of the sheet feeding following the end of the printing, the FIG. 5 sheet-feeding/processing control routine is executed. Therefore, when the sheet 5 is fed out for the final cutting, if an imaginary line to be processed is left on the sheet 5 between the printing head 10 and the cutter 16, the sheet 5 is processed while the feeding of the sheet 5 following the end of printing operation is interruptively stopped during its feeding. Finally, the sheet 5 is cut along the final imaginary cut line. After the final cutting, the sheet feed motor 22 is driven to rotate in the sheet feeding direction, and after a sheet sensor (not shown) senses the discharging of the sheet as cut, the sheet feed motor 22 is reversely rotated, and the sheet 5 is moved back till the leading edge of the sheet can be held with the sheet feed roller 7. And the control waits for the next incoming print data.

If paper jam occurs during the printing operation, the sheet is fed, by manual operation, to a position of the not printed area. After the manual operation at the time of paper jam, the processing position Pn and the data representative of the processing contents corresponding to the processing position are left in the position storing part 66. Accordingly, the printer 1 starts again the printing operation based on those processing information.

The embodiment of the invention has the following effects.

1) The sheet 5 may be processed during the feeding operation of the sheet 5.

Specifically, the printed sheet 5 is processed (cut, folded, etc.) only by feeding the printed sheet 5 in the sheet feeding direction, viz., not moving it back. Accordingly, even if a construction that the processing devices 15 and 16 are mounted on the printer 1, and the sheet 5 is processed is employed, little time printing time occurs. It is almost free from the possibility that the printing surface of the sheet repeatedly passes the rollers 6, 7 and the like, and the printing surface is damaged by its rubbing. Since the sheet 5 is not moved back in the processing of the sheet, the print interruptive time taken for the sheet processing is relatively short. Accordingly, there is less chance of formation of the printing irregularity (color changing lines), which will otherwise be formed when the print interruptive time is long. When the method that the sheet 5 is moved back, and is processed, and then is fed back in the sheet feeding direction, is employed, a position of the sheet 5 is minutely shifted from its correct position by a backlash (play) of the gear forming a gear mechanism for transmitting the power of the sheet feed motor 22 to the drive rollers 7*a* and 8*a*, causing the printing irregularity. In the embodiment, the sheet 5 is not moved back. Therefore, the embodiment is free from the printing irregularity caused by the backlash of the gear.

2) Even in a case where because of presence of a blank portion, not printed, on the sheet, an amount of sheet feeding per one sheet feeding operation is long, the sheet feed amount is divided in accordance with the processing position. Accordingly, the sheet 5 is stopped at an exact position where the imaginary line on the sheet is coincident with the processing device. For this reason, even in the case where the sheet feed amount per one sheet feeding is long, the sheet 5 is processed without moving back the sheet 5. Accordingly, the printing stop time for the sheet processing is reduced to be as short as possible, and there is no chance that the color changing problem arises from the long printing interruptive time.

3) At the end of printing operation, if a printing end command is present in the print data, the control judges that the printing operation ends, and the sheet 5 is automatically fed out, and the sheet is automatically cut at the end of the final page (final cutting position). In addition to the function of cutting the sheet at the end of the final page, when an imaginary line that will pass the processing device during the feeding of the sheet is present, the sheet is stopped during its feeding and the sheet 5 is processed along the imaginary line. Accordingly, after the printing ends, the imaginary lines on the sheet are all processed automatically, and the end of the final page is automatically cut. Also in this case, the sheet is fed forward without being moved back, and during its feeding it is stopped and processed. Much time is not consumed for the sheet processing, and the printing surface of the sheet little suffers from the damage of the printing surface of the sheet due to rubbing.

The sheet 5 is successively folded and cut by the folding device 15 and the cutter 16 mounted on the printer 1, while being fed in the sheet feeding direction and stopped during the course of its feeding. Therefore, every processing of the sheet is completely carried out irrespective of the layout of the cutting and folding positions. In a case where the printer prints on a decorative paper of a CD case or the like, when the printed sheet 5 is discharged from the printer 1, the printing, folding, and cutting of the decorative paper have been completed since the printer is provided with the folding device 15 and the cutter 16. Accordingly, the productivity of this type product is considerably high.

Second Embodiment

A second embodiment of the present invention will be described with reference to FIGS. 7 through 9. In the instant embodiment, the printer driver 33 computes a sheet feed amount on the basis of processing position data, such as a cutting position, folding position, perforation position and the like, as input from the input device 36. For this reason, there is no need of dividing the sheet feed amount in the printer. The sheet may be fed by a sheet feed amount as instructed by the sheet feed command imparted to the print data. Further, the operation of inputting and setting an imaginary line position on the sheet where the sheet is to be processed on the screen, is simplified.

Figure 7:
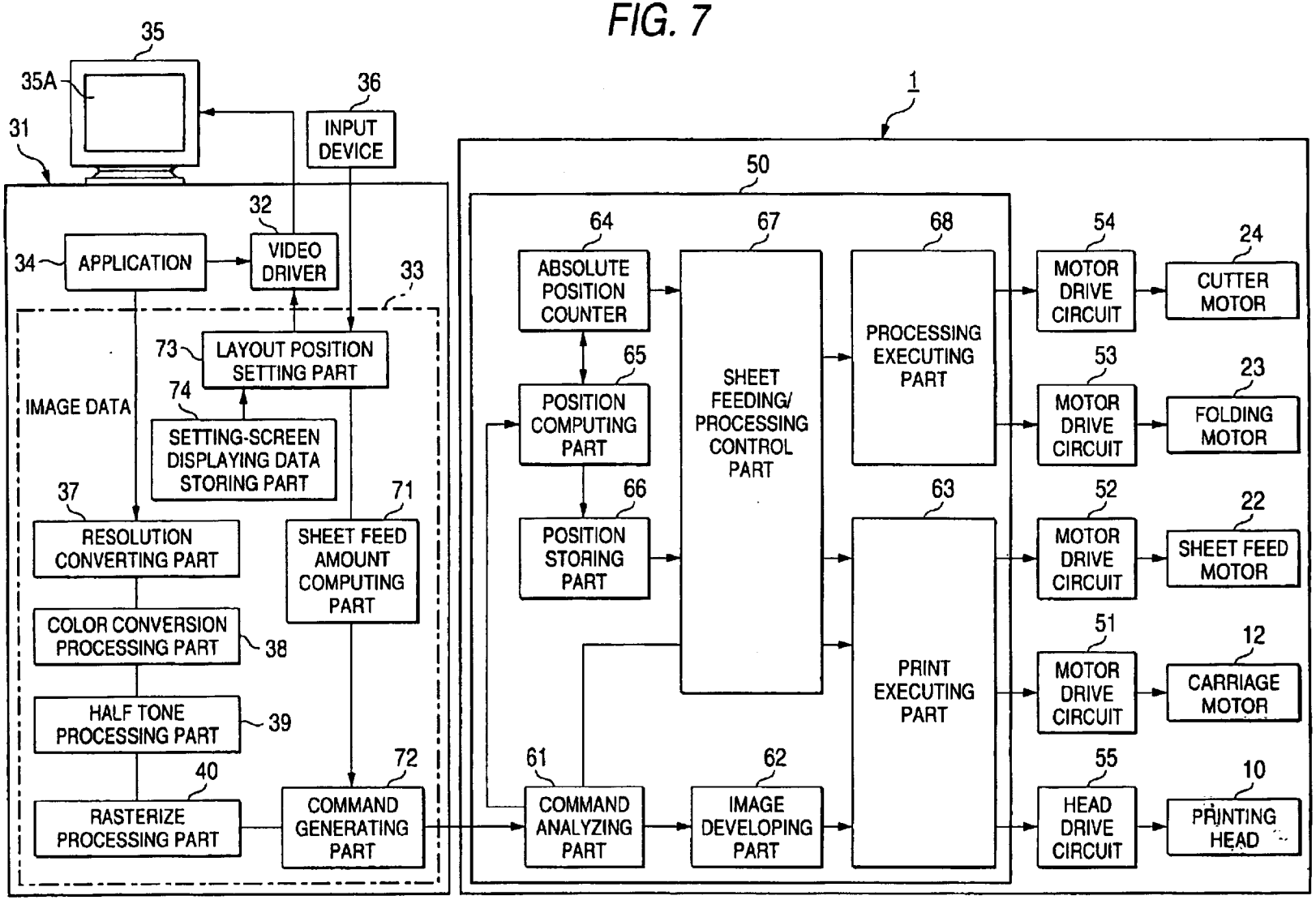
FIG. 7 is a block diagram showing a configuration of a print system which is a second embodiment of the invention.

FIG. 7 is a block diagram showing a configuration of a print system which is a second embodiment of the invention.

A difference of the instant embodiment resides in that the printer driver 33 includes a sheet feed amount computing part 71 for computing a sheet feed amount on the basis of processing position data. The command generating part 72 generates a sheet feed command on the basis of a sheet feed amount computed by the sheet feed amount computing part 71. Print data imparted with the sheet feed command is transmitted (output) to the printer 1. The position computing part 65, which is used in the first embodiment, is not used in the printer 1.

The layout position setting part 73 contained in the printer driver 33 controls a screen display on the basis of various data stored in the setting-screen displaying data storing part 74, and assists one to set and change the processing position data on the screen by use of the input device 36. Thus, the printer driver 33 manages the setting/changing assist process for assisting one to set and change the processing position data, and the sheet feed command generating process for generating the sheet feed command from the processing position data.

The printer driver 33 is constructed in a manner that a program for printer driver as a print control program, which is store in a CD-ROM, is read out and installed on the host computer 31. The layout position setting part 73 contains a processing ion setting/changing assist program flow charted in FIG. 9.

A screen processing to assist one to set and change the processing position will be described with reference to FIGS. 8 and 9. A perforation processing device, not shown, for forming a line of perforations in the sheet 5 is disposed between the folding device 15 and the cutter 16. FIG. 8 shows a setting screen 75. Cutter, folding, and perforations may be set on the setting screen 75. One of the programs to assist one to set and change imaginary line positions of those items on the sheet, is flow charted in FIG. 9.

Figure 8:
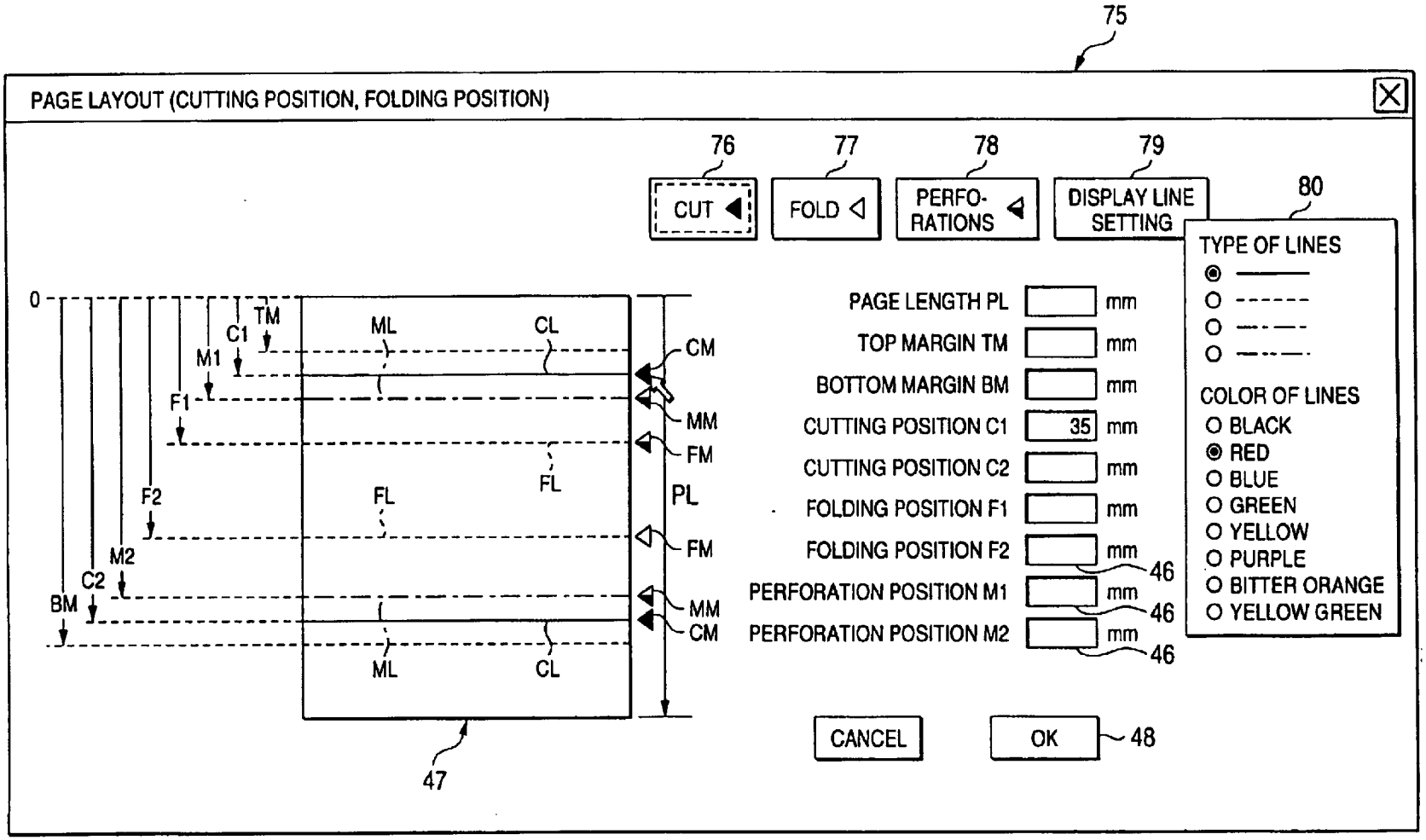
FIG. 8 is a diagram showing a setting screen for setting a page layout.
Figure 9:
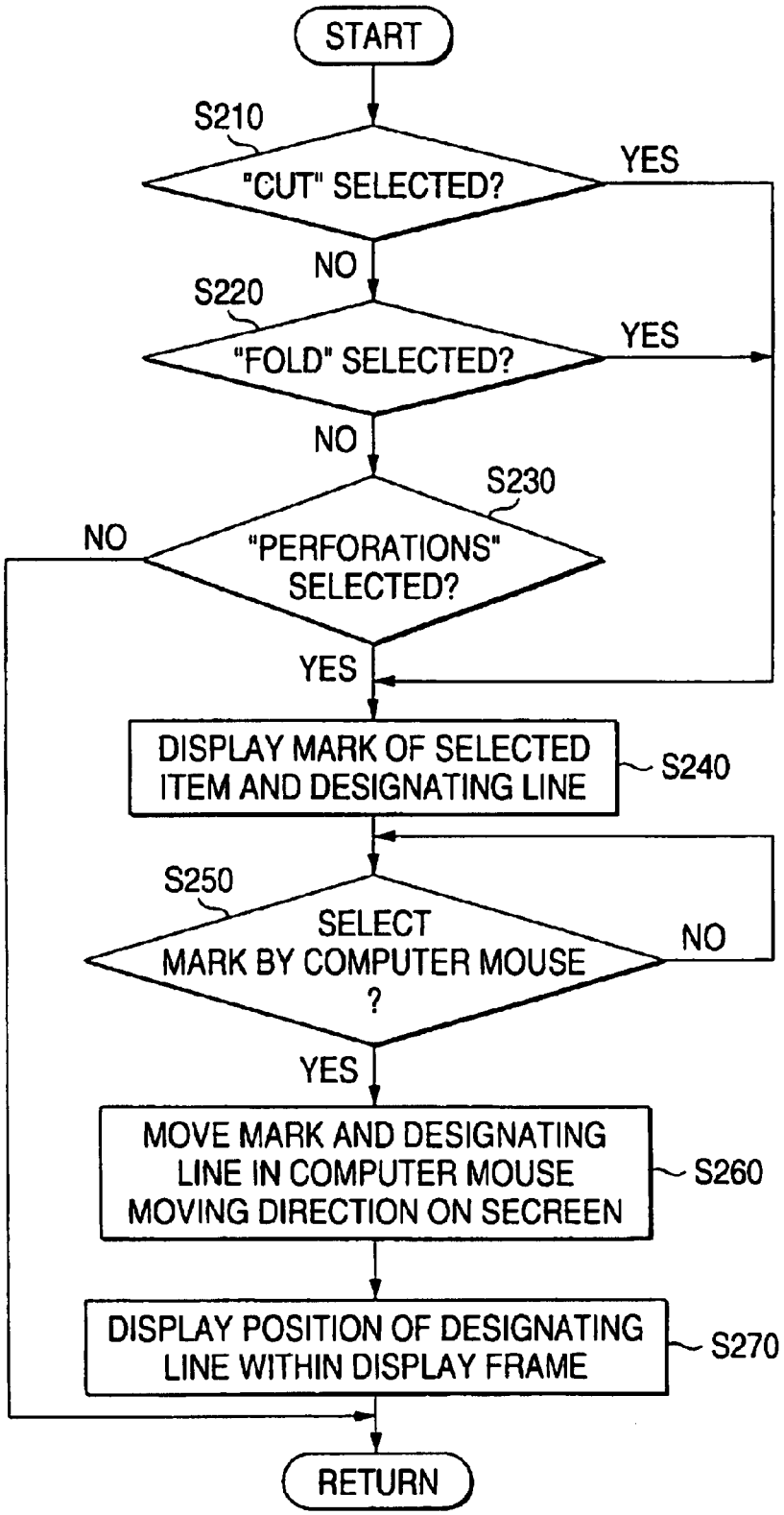
FIG. 9 is a flow chart showing a processing-position setting assist process.

As shown in FIG. 8, page length PL, top margin TM, bottom margin BM, cutting positions C1 and C2, folding positions F1 and F2, and perforation positions M1 and M2 may be input, for each page, to input fields 46 on the layout setting screen 75, and specified in terms of specific values, by operating the input device 36. The setting screen 75 contains a cut button 76, folding button 77, perforation button 78 and display line setting button 79. Those buttons 76, 77 and 78 are provided for setting a cut position (black triangle position mark in the figure), folding position (white triangle position mark in the figure), perforation position (black/white triangle position mark in the figure) on the page image 47. When the buttons 76, 77 and 78 are operated, the positions marks corresponding to the buttons operated, and lines at the positions corresponding to the position marks, viz., cutting line (solid line in the figure), folding line (broken line in the figure) and perforation line (one dot chain line in the figure) are displayed on the page image. Further, input fields 46, together with the names of the corresponding position data, are displayed on the screen. The input fields 46 of the number equal to the number of operations of the buttons 76, 77 and 78 are automatically set.

The display line setting button 79 is for designating types and colors of lines displayed. One of buttons 76, 77 and 78 is selected (made effective), and the display line setting button 79 is operated. Then, a display line select screen 80 is displayed. If one selects the type of line and the line color, the display line corresponding to the selected one of the cut, fold, and perforation buttons is set at the contents as set. The term "print unit" means a unit used for setting the layout.

Upon the operation of the input device 36, a position mark is selected and vertically shifted on the page image 47 by use of a computer mouse (a mouse arrow in the figure). When the line is shifted, a value based on the position of the line may be put in the corresponding input field 46. When a numerical value is entered into an input field 46, the line moves to a position corresponding to the numerical value. After the values PL, TM, BM, C1, C2, F1, and F2 are all entered, one operates an OK button 48. In turn, those page data PL, TM, BM and processing position data C1, C2, F1, F2 are accepted by the layout position reception part 42.

A process to assist one to set and change the processing position will be described with reference to a flow chart of FIG. 9. To start, processes of S210 to S230 are for judging which button is selected from among the cut button 76, fold button 77 and perforation button 78. In S210, the printer driver judges whether or not the cut selection is made, viz., whether or not the cut button 76 is selected. In S220, the printer driver judges whether or not the fold selection is made, viz., whether or not the fold button 77 is selected. In S230, the printer driver judges whether or not the perforation selection is made, viz., whether or not the perforation button 78 is selected. If the button is not selected in each of those steps S210 to S230, the driver program advances to the next button select judging process. If the button is selected, the program advances to S240. In other words, if one of the three buttons 76 to 78 is selected, the program advances to S240.

In S240, one of marks CM, FM and MM of the selected item (cut, fold and perforation) and one of designating lines CL, FL and ML are displayed on the screen. For example, if the cut button 76 is selected, the mark CM (black triangle) and the designating line ML are displayed. At this time, the designating line CL is displayed with the designation of the predetermined type and color of line on the display line select screen 80, opened by selecting the display line setting button 79. The position of the designating line CM displayed at this time is, for example, a default value and not always a position as desired by the user. Accordingly, the user sets a desired position of the designating line by operating the computer mouse. A print image, not shown in FIG. 8, is displayed in the page image 47. Accordingly, the user may set an appropriate position of the cutting, folding and perforation position, while checking the print image on the screen.

In S250, the driver program judges whether or not the mark is moved by selecting the mark with the computer mouse. If the mark is not moved, the program waits without any action till the next operation is done. In the flow chart, only the judging process about the mark moving operation by the computer mouse is illustrated. Also when another operation (e.g., operation to select another button) is performed, the program exits from this process. If the mark moving operation is performed, the program proceeds to the next S260.

In S260, a display process is executed, which moves the mark and the designating line in the direction in which the mouse moves. For example, when the user moves the mark upward or downward by operating the mouse to adjust the position of the designating line, the designating line displayed moves following the mark, so that the designating line is set to the position desired by the user.

S270 executes a process to put positional dimensions of the designating lines into the display frames (input fields) 46. Through the process, numeral values representing the positions of the designating lines are displayed in the input fields 46 corresponding to the mark operated by the computer mouse. Accordingly, the user can adjust the position of the designating line while checking the displayed numeral value. For example, in a state that the cut button 76 is selected, if the position of the designating line is adjusted by operating the mark (black triangle) with the mouse (in the figure an arrow mark is a pointer of the mouse), a numeral value ("35" in the instance) representing the position of the designating line is displayed in the corresponding input filed 46, as shown in the figure.

In this way, by operating the buttons 76 to 78 contained in the setting screen 75 and by operating the mouse to adjust the position of the mark, the cut position, the fold position and the perforation position may be set on the page image 47. When the user changes a numeral value as input and displayed in the input field 46 by operating the keyboard, the position mark and the designating line corresponding to the input field 46 shift to the positions as specified by the numeral value as input. After the desired positions of those positions, cutting, folding and perforation positions are all set at desired positions, the OK button 48 is operated to determine the positions of the imaginary lines on the sheet which are to be processed.

The determined processing position data (cutting position data, folding position data and perforation position data) and the other layout data (top margin or bottom margin) are transmitted from the layout position setting part 73 to the sheet feed amount computing part 71.

The sheet feed amount computing part 71 computes a sheet feed amount based on the print condition data, print data and the processing position data. More exactly, sheet feed pitch at the printing time and a sheet feed amount for a page break are determined on the basis of the print condition data set in the printer driver 33. In the rasterize processing part 40, it a margin part is present in an image to be printed, the margin part is managed as a part of sheet feeding. The sheet feed amount computing part 71 executes a process of appropriately dividing the sheet feed amount determined on the basis of the print condition data and the print data so that the sheet stops in a state that the imaginary line to be processed is coincident with the corresponding processing device, and computes the sheet feed amount based on those data. Specifically, the sheet feed amount computing part computes the sheet feed amount based on the print position as determined by the position data TM, BMCi, Fj and Mk (i, j, k=1, 2, . . . ) on the page image 47 and raster data of the print image so that the sheet stops at the print position and the processing position of the sheet in the sheet feed direction. The command generating part 72 generates a sheet feed command (print data command) from the sheet feed amount as computed by the sheet feed amount computing part 71, and imparts the generated command to the header of the print data to thereby generate the print data. The sheet feed command of the first embodiment indicates a sheet feed sheet feed amount to stop the print position on the sheet at the printing head position. The sheet feed command generated by the printer driver 33 of the embodiment indicates a sheet feed amount to stop the print position on the sheet at the printing head position, and a sheet feed amount to stop the imaginary line on the sheet stops at a position of the processing device.

The folding device 15 as a processing device, the cutter 16 and the perforation processing device are disposed at different positions spaced apart from one another on the discharge side of the printing head 10. A sheet feed amount make the sheet feeding allowing the sheet to be stopped in a state that the imaginary line is located at the position of the processing device corresponding thereto (a position state enabling the device to process the sheet along the imaginary line) is computed allowing for the distances between the printing head 10 and the processing devices 15, 16 and the like. The sheet feed command contains the sheet feet order and the sheet feed amount.

The command generating part 72 generates a command which instructs a process to be executed after the sheet feeding in addition to the sheet feed command. The command contains a command (actuator command) which instructs which of actuators to be operated after the sheet feeding for the processing is performed. Specifically, a cutter operating command is set as an instruction subsequent to the sheet feed command determined by the cutting position data. A folding device operating command is set as an instruction subsequent to the sheet feed command determined by the folding position data. Further, a perforation processing operating command is set as an instruction subsequent to the sheet feed command determined by the perforation position data. The processing executing part 68 drives and controls a perforation processing motor 81 through a motor drive circuit 82 according to the perforation processing operating command. The print data command contains various commands necessary for the printing control, in addition to the sheet feed command.

The print data PD to which the command as generated by the command generating part 72 is imparted is transferred from the printer driver 33 to the printer 1. The command analyzing part 61 in the printer 1 analyzes the command imparted to the print data PD. The sheet feed amount obtained through the command analyzing and the data to designate an actuator to be operated after the sheet feeding are transmitted to the position computing part 65.

An absolute position Ppre of the present head position (printing position) may be known from the count value of the position counter 64 as in the first embodiment. The position computing part 65 computes the cutting position AC, folding position AF, and the perforation position AM of a page, not yet processed, on the basis of the count value (present printing position Ppre) of the absolute position counter 64, and the requested sheet feed amount Sreq. The computed position data AC, AF and AM are stored in the position storing part 66. The position data stored in the position storing part 66 is used for determining the timing of driving the actuator, and for dividing the sheet feed amount Sreq as in the first embodiment.

The sheet feeding/processing control part 67 makes out a schedule for feeding the sheet by the sheet feed amount Sreq, which results from the command analysis, and further makes out such a schedule that when the count value of the absolute position counter 64 is equal to a value of the position data stored in the position storing part 66, the actuator corresponding to it is operated.

The print executing part 63 computes the number of steps (sheet feed amount Sreq) for driving the sheet feed motor 22 to the motor drive circuit 52. The sheet is fed when the sheet feed motor 22 is drive to rotate by the sheet feed amount Sreq. When the count value of the absolute position counter 64 is coincident in value with the position data stored in the position storing part 66, the processing executing part 68 drives the actuator corresponding to the data position after the stopping of the sheet feed motor 22 is confirmed. When the count value is coincident with the cutting position AC, the cutter motor 24 is driven through the motor drive circuit 54, and the cutting of the sheet is performed. When the count value is coincident in value with the folding position AF, the folding motor 23 is driven through the motor drive circuit 53, and the folding process is carried out for folding the sheet 5. When the count value is coincident in value with the perforation position AB, the perforation processing motor 81 is driven through a motor drive circuit 82, and the perforation processing operation for making perforations in the sheet 5 is performed.

In addition to the effects as of the first embodiment, the following effects are produced.

5) The printer driver 33 in the host computer 31 computes a sheet feed amount on the basis of processing position data as input, allowing for the stopping of the sheet at the processing position, and forms print data PD imparted with a sheet feed command indicative of the computed sheet feed amount. Accordingly, the printer 1 may perform a sheet feeding operation capable of stopping the sheet 5 in a state that the imaginary line on the sheet 5 is coincident with the folding device 15, 16 or the like. Therefore, the CPU of the host computer 31 having high processing ability executes the computing process of dividing the sheet feed sheet feed amount. No load is imparted to the CPU of the printer 1 for the computing process execution.

6) When processing position data is input on the setting screen 75 by use of the input device 36, the processing position setting operation and the setting changing operation are simply performed since the processing position may be simply set through the positioning of the designating line by the button operation and the mouse operation. The types and colors of designating lines may be displayed, while being respectively assigned to the different processing contents. With easy-to-discriminate and easy-to-see features given to the designating lines, the setting operation is easy.

Modifications of the embodiments mentioned above will be described here under.

<Modification 1>

The second embodiment uses two execution parts, the print executing part 63 for the print control and the processing executing part 68 for controlling the actuators for the processing devices. One execution part may be used instead. Specifically, one CPU and one ASIC are used for the print control and the processing control. For example, one CPU and a program are used to form the sheet feeding/processing control part 67 for making out a schedule for the printing/processing, and a printing/processing executing part for executing the printing and sheet-processing processes. The absolute position counter 64, position computing part 65 and the position storing part 66 are omitted or not used for the controls. In this case, actuator command which is generated, by the printer driver 33, for instructing the operation of the processing device actuator, is imparted to the header of the print data, together with a sheet feed command. The sheet feeding/processing control part 67 makes out a schedule of the sheet feeding operation of the sheet feed amount Sreq and the actuator operation on the basis of the command analyzing result. The printing/processing executing part controls the operations of the sheet feed motor 22 and the processing device actuators 23, 24, 81 in accordance with the schedule made out by the sheet feeding/processing control part 67. In this modification thus arranged, the sheet feeding operation and the actuator operation are controlled by the command. Accordingly, there is no need of managing the processing positions to determine the operation timings of the processing device actuators. Therefore, the load to the CPU and the like in the printer is further lessened.

<Modification 2>

In the first embodiment, the processing device is not limited to the cutter and the folding device, but it may additionally involve the perforation processing device for making perforations in the printed sheet. Other type of processing devices may also be used, as a matter of course. Any type of processing device if it is capable of processing the printed sheet may be used for the processing device handled in the invention. Even another type of processing device is able to efficiently process the printed sheet during its sheet feeding process.

<Modification 3>

In the embodiments mentioned above, two or three processing devices are provided, but if required, one processing device may be used instead. For example, only the cutter may be used. Only the folding device may be provided. Only the perforation processing device may be provided. In either case, the sheet is efficiently processed during the sheet feeding, by use of the single processing device.

<Modification 4>

When a plurality of processing devices are provided, those are not limited to the combination of the cutter and the folding device. The perforation processing device and the cutter may be combined. The perforation processing device may be combined with the folding device. Three processing devices, cutter, folding device and the perforation processing device may be combined. In any of the combination of those devices, the sheet is efficiently processed during the sheet feeding, by use of those processing devices.

<Modification 5>

A sheet feed sheet feed amount for processing the sheet is set in a sheet feed command imparted to the print data in advance. The sheet feeding for operating the processing device, not for the printing, and which of the processing devices (actuators) is operated are also set in the command. The printer carries out the print sheet processing control for operating and controlling the sheet feed motor and the actuator for the processing device.

<Modification 6>

For the sheet feeding/processing control, the processing position is managed in terms of printing head position by using the count value (absolute value) of the absolute position counter 64. The reference position for managing the absolute position on the sheet may be any other position than the printing head position. If one processing device is used, the position of an imaginary line on the sheet may be used for the processing position for the sheet feeding/processing control.

<Modification 7>

It is not essential that the reception process program for receipt the input screen display data for designating the processing position and the processing position data is contained in the printer driver. It may be contained in the application program.

<Modification 8>

The sheet is not limited to the roll sheet, and the printer is not limited to the printer capable of handling the roll sheet. The sheet may be a form, and the printer may be a printer capable of printing on the form.

<Modification 9>

The cutter may be provided on the carriage for the sheet feeding/processing control, and the control is carried out as in the embodiments mentioned above. In this case, the actuator serves as a carriage motor.

<Modification 10>

In the embodiments mentioned above, the printing operation is temporarily stopped when the sheet is processed. If required, the sheet processing and the printing operation may be performed concurrently.

<Modification 11>

In each embodiment mentioned above, the invention is applied to a printer (printing device) which performs the printing based on the print data as received from the host computer (PC). The present may be applied to a called stand-alone printer which is operable for printing without aid of the host computer (PC). The stand-alone printer (printing device) is provided with an image reader. Image data is read out from a memory card, which has been inserted into a slot of the image reader. A control unit (e.g., CPU, ASIC and the like) having an image processing part for converting image data to print data, and a control unit and a print processing part for executing a printing process based on the print data having undergone the conversion processing by the image processing part, is contained in the main body of the printer. In this case, the control unit contains a control part 50 having a function similar to that of each embodiment of the invention. The control unit has an additional function which enables the user to input and set processing condition designating information (containing processing type designating information and imaginary line designating data), such as processing type and processing position on the operation panel. An operation panel installed on the main body of the stand-alone printer includes a display screen (setting screen) of a display device (display means) formed with, for example, a liquid crystal display part, and an operation part (operation switch) as input operation means for setting various setting conditions and the like. The setting screen allows the user to select and set the type of processing and the imaginary line position. A monitor device is installed on the main body of the stand-alone printer. A print image selected by the user is displayed in a pre-view fashion on the monitor screen of the monitor device. In the second embodiment, the user inputs and sets the imaginary line designating data on the host computer side. In the stand-alone printer, the user operates the operation part of the main body, while watching the setting screen, thereby to directly input and set imaginary line designating data. The processing position is input in terms of numerical values and finely adjustable. The contents as entered is presented on a print image on the monitor screen. The processing position is depicted in the form of, for example, a line of a specific type and color, which enables one to distinctly recognize the type of the processing contents, as in the second embodiment, for example. Menu data for displaying the setting screen, depicting process data for monitor display, and depicting process program are stored in a memory. The CPU executes a setting program on the basis of the input data as entered from the operation part, whereby a setting process including the display process and the depicting process is executed.

<Modification 12>

The method of generating the imaginary line designating data is not limited to the generating method for generating it generated from the processing position data (imaginary line data) as input from the input/operation means (display device 35) by the user. Another method of generating the imaginary line designating data is that the control part judges the processing position from other setting information, and acquires it, and generates that data based on the aquired data. For example, the control part recognizes a position at which the sheet is cut at a setting sheet size based on the information of the setting sheet size, as imaginary line designating data, and acquires it. In this case, the sheet size may be designated on the setting screen. The control part (CPU) judges a position at which the sheet may be cut at the setting sheet size, based on the setting sheet size information to be imaginary line designating data, and acquires it. A print area (e.g., layout information) may be designated on the setting screen. The control unit (CPU) judges, for each print area, a sheet cutting position to be imaginary line designating data on the basis of information of the designated print area, and acquires the same. To make the sheet cutting of one cut (one cut position between adjacent images), the CPU judges a boundary position between the adjacent images to be imaginary line designating data, and acquires it. To make the sheet cutting of two cut (two cut positions between adjacent images since the blank is cast), the CPU judges the imaginary line designating data to be the data to cut the sheet at two positions allowing the blank between the images to be removed, and acquires it. Further, information of sheet size and print area is not limited to the information directly designated by the user. The control unit may use other information, such as information detected by a sheet size sensor, and image designating area for its judgement. In those arrangements, the printer automatically recognizes the processing position (imaginary line position), and cuts the sheet at an appropriate position. Accordingly, there is no need for the user's inputting operation of the processing position (imaginary line position). If the processing position automatically recognized is not correct, what the user has to do is to correct only the incorrect position by the input operation. Accordingly, the user's mental stress is lessened in the input operation.

<Modification 13>

The imaginary line position, which is managed by the counter or the like to control the actuator of the processing device is not limited to the absolute position on the sheet. In an alternative, the imaginary line position is managed in terms of a relative position on the sheet to control the actuator of the processing device.

The technical ideas involved in the above-mentioned embodiments and other examples will be given hereunder.

1) A printer having printing means for printing on a sheet by driving a printing head and a carriage, transporting means for transporting the sheet from an upstream part to a downstream part with respect to the printing head, processing means for applying a process along an imaginary line on the sheet at a fixed position located downstream of the printing head, and control means for controlling the printing means, the transporting means and the processing means such that a sheet transporting operation and a printing execution are alternately performed, and after the sheet movement is stopped upon occasion, the processing is carried out, the improvement being characterized in that input operation means for inputting setting an imaginary line at a desired position on a sheet, and the control means acquires an imaginary line position on the sheet from imaginary line data from the input operation means, and when the sheet is fed by a predetermined sheet feed amount in order to print successively incoming data, at the instant that an imaginary line on the sheet reaches a processing position, the control means 1) stops the movement of the sheet, 2) ceases the printing operation of the successively incoming data, and 3) causes the processing means to process the sheet along the imaginary line on the sheet.

2) A printer depends from the technical idea 1) above, and includes display means for displaying a setting screen for the imaginary line, and a position of an imaginary line on the sheet is acquired from the imaginary line data which is selectively input on the setting screen by operating the input operation means.

3). A printer depends from the technical idea 2) above, and includes reading means for reading image data from a storing medium, a display means for displaying a print image based on the image data on the screen, and depicting means for depicting an imaginary line at a position on the print image corresponding to the imaginary line designated by the input means, on the screen.

As seen from the foregoing description, in the present invention, a printed sheet is subjected to a predetermined processing, and the sheet processing is not accompanied by the moving back of the sheet. Therefore, a predetermined sheet processing, such as cutting and folding, may be efficiently applied to the printed sheet.

Further, the invention assists one in the work for setting the position of an imaginary line on the sheet, which is necessary for automatizing the application of a given processing to the printed sheet.

Although the invention has been described in its preferred formed with a certain degree of particularity, it is understood that the present disclosure of the preferred form can be changed in the details of construction and in the combination and arrangement of parts without departing from the spirit and the scope of the invention as hereinafter claimed.

What is claimed is:

1. A printer comprising:

printing means for printing on a sheet of paper by driving a printing head and a carriage;

transporting means for transporting the sheet from an upstream part to a downstream part with respect to said printing head;

processing means for applying a process along an imaginary line on the sheet at a fixed position located downstream of said printing head; and control means for controlling said printing means, said transporting means and said processing means such that a sheet transporting operation and a printing execution are alternately performed, and after the sheet movement is stopped upon occasion, said process is carried out, wherein, when the sheet is fed by a predetermined sheet feed amount in order to print successively incoming data, at the instant that an imaginary line on the sheet reaches a processing position, said control means 1) stops the movement of the sheet, 2) causes said processing means to process the sheet along said imaginary line, and 3) causes said printing means to restart printing said successively incoming data without moving back the sheet from the downstream part to the upstream part before printing said successively incoming data.

2. A printer according to claim 1, wherein when the sheet is fed by said predetermined sheet feed amount in order to print successively incoming data, said control means judges whether or not said imaginary line on the sheet will move beyond a processing position of said processing means, when said imaginary line will go beyond said processing position, said control means carries out a process to divide said sheet feed amount into first and second sheet feed amounts so that the sheet stops at a position where said imaginary line on the sheet reaches said processing position, executes a sheet transportation of said first sheet feed amount prior to a sheet transportation of said second sheet feed amount, thereby to stop the movement of the sheet at a point where said imaginary line reaches said processing position.

3. A printer according to claim 2, wherein said control means causes said transporting means to execute said sheet transportation of said second sheet feed amount after said processing means processes the sheet along said imaginary line on the sheet, and restarts the printing of said successively incoming data.

4. A printer according to claim 1, wherein said imaginary line on the sheet is based on any of a sheet size as set, a printing area on the sheet, and designation by a user.

5. A printer according to claim 1, wherein said process is any of processes of cutting the sheet, folding the sheet, and forming a perforation in the sheet.

6. A driver program for issuing commands to cause a printer to alternately perform a sheet transporting operation and a printing execution, and to stop the sheet movement upon occasion, said printer having printing means for printing on a sheet of paper by driving a printing head and a carriage, transporting means for transporting the sheet from an upstream part to a downstream part with respect to said printing head, processing means for applying a process along an imaginary line on the sheet at a fixed position located downstream of said printing head, wherein said driver program causes a computer to perform steps of:

judging whether or not said imaginary line on the sheet will move beyond a processing position of said processing means, when the sheet is fed by a predetermined sheet feed amount in order to print successively incoming data;

carrying out, when said imaginary line will go beyond said processing position, a process to divide said sheet feed amount into first and second sheet feed amounts so that the sheet stops at a position where said imaginary line on the sheet reaches said processing position; and issuing a first command to execute a sheet transportation of said first sheet feed amount and a second command to execute a sheet transportation of said second sheet feed amount, without moving back the sheet from the downstream part to the upstream part between the first command and the second command.

7. A driver program according to claim 6, wherein said driver program issues to said computer said second command after said first command is issued.

8. A printing system including a host computer and a printer, comprising:

printing means for printing on a sheet of paper by driving a printing head and a carriage;

transporting means for transporting the sheet from an upstream part to a downstream part with respect to said printing head, processing means for applying a process along an imaginary line on the sheet at a fixed position located downstream of said printing head; and control means for controlling said printing means, said transporting means and said processing means such that a sheet transporting operation and a printing execution are alternately performed, and after the sheet movement is stopped upon occasion, said process is carried out;

wherein, when the sheet is fed by a predetermined sheet feed amount in order to print successively incoming data, said control means judges whether or not said imaginary line on the sheet will move beyond a processing position of said processing means, and when said imaginary line will go beyond said processing position, said control means carries out a process to divide said sheet feed amount into first and second sheet feed amounts so that the sheet stops at a position where said imaginary line on the sheet reaches said processing position, and said control means causes said transporting means to execute a sheet transportation by the first sheet feed amount, and ceases the printing operation of said successively incoming data, and causes said processing means to process the sheet along said imaginary line and causes said transporting means to execute a sheet transportation by the second sheet feed amount without moving back the sheet from the downstream part to the upstream part between the sheet transportation by the first sheet feed amount and the sheet transportation by the second sheet feed amount.

9. A print system according to claim 8, wherein said sheet feed amount dividing process is executed in said printer.

10. A print system according to claim 8, wherein said sheet feed amount dividing process is executed in said host computer.

11. A printing method for a printer having printing means for printing on a sheet of paper by driving a printing head and a carriage, transporting means for transporting the sheet from an upstream part to a downstream part with respect to said printing head, processing means for applying a process along an imaginary line on the sheet at a fixed position located downstream of said printing head, and control means for controlling said printing means, said transporting means and said processing means such that a sheet transporting operation and a printing execution are alternately performed, and after the sheet movement is stopped upon occasion, said process is carried out, wherein said printing method comprises steps of:

judging whether or not said imaginary line on the sheet will move beyond a processing position of said processing means when the sheet is fed by a predetermined sheet feed amount in order to print successively incoming data;

carrying out a process to divide said sheet feed amount into first and second sheet feed amounts so that the sheet stops at a position where said imaginary line on the sheet reaches said processing position, when said imaginary line will go beyond said processing position;

executing a sheet transportation of said first sheet feed amount prior to a sheet transportation of said second sheet feed amount;

ceasing the printing operation of said successively incoming data, and causing said processing means to process the sheet along said imaginary line; and executing the sheet transportation of said second sheet feed amount without moving back the sheet from the downstream part to the upstream part between the sheet transportation of said first sheet feed amount and the sheet transportation of said second sheet feed amount.

12. A processing method of processing a driver program which issues commands to a printer having printing means for printing on a sheet of paper by driving a printing head and a carriage, transporting means for transporting the sheet from an upstream part to a downstream part with respect to said printing head, processing means for applying a process along an imaginary line on the sheet at a fixed position located downstream of said printing head, and control means for controlling said printing means, said transporting means and said processing means such that a sheet transporting operation and a printing execution are alternately performed, and after the sheet movement is stopped upon occasion, said process is carried out, wherein said processing method comprising steps of:

judging whether or not said imaginary line on the sheet will move beyond a processing position of said processing means, when said transporting means is caused to feed the sheet by a predetermined sheet feed amount in order to print successively incoming data;

carrying out, when said imaginary line will go beyond said processing position, a process to divide said sheet feed amount into first and second sheet feed amounts so that the sheet stops-at a position where said imaginary line on the sheet reaches said processing position;

issuing a command to execute a sheet transportation of said first sheet feed amount prior to a command to execute a sheet transportation of said second sheet feed amount; and issuing a command to execute the sheet transportation of said second sheet feed amount without moving back the sheet from the downstream part to the upstream part between the sheet transportation of said first sheet feed amount and the sheet transportation of said second sheet feed amount.

13. A driver program for issuing commands to a printer having printing means for printing on a sheet of paper by driving a printing head and a carriage, transporting means for transporting the sheet from an upstream part to a downstream part with respect to said printing head, processing means for applying a process along an imaginary line on the sheet at a fixed position located downstream of said printing head, and control means for controlling said printing means, said transporting means and said processing means such that a sheet transporting operation and a printing execution are alternately performed, and after the sheet movement is stopped upon occasion, said process is carried out, wherein said driver program causes a computer to serve as means for judging whether or not said imaginary line on the sheet will move beyond a processing position of said processing means, when said transporting means is caused to feed the sheet by a predetermined sheet feed amount in order to print successively incoming data, means for carrying out, when said imaginary line will go beyond said processing position, a process to divide said sheet feed amount into first and second sheet feed amounts so that the sheet stops at a position where said imaginary line on the sheet reaches said processing position, and means for issuing a command to execute a sheet transportation of said first sheet feed amount prior to a command to execute a sheet transportation of said second sheet feed amount, and means for issuing a command to execute the sheet transportation of said second sheet feed amount without moving back the sheet from the downstream part to the upstream part between the sheet transportation of said first sheet feed amount and the sheet transportation of said second sheet feed amount.

14. A printer comprising:

printing means for printing on a sheet of paper by driving a printing head and a carriage;

transporting means for transporting the sheet from an upstream part to a downstream part with respect to said printing head, processing means for applying a process along an imaginary line on the sheet at a fixed position located downstream of said printing head;

control means for controlling said printing means, said transporting means and said processing means such that a sheet transporting operation and a printing execution are alternately performed, and after the sheet movement is stopped upon occasion, said process is carried out; and processing position designating means for designating a desired processing position on the sheet as an imaginary line where said process is carried out; and wherein said control means includes means for controlling feeding of the sheet a predetermined sheet feed amount, means for judging when said imaginary line will go beyond said processing position and means for carrying out a process to divide said sheet feed amount into different first and second sheet feed amounts.

15. A printer comprising:

printing means for printing on a sheet of paper by driving a printing head and a carriage;

transporting means for transporting the sheet from an upstream part to a downstream part with respect to said printing head, processing means for applying a process along an imaginary line on the sheet at a fixed position located downstream of said printing head; and control means for controlling said printing means, said transporting means and said processing means such that a sheet transporting operation and a printing execution are alternately performed, and after the sheet movement is stopped upon occasion, said process is carried out, wherein said control means includes means for managing said imaginary line on the sheet in the terms of a logical position on the sheet as obtained based on an accumulative value of a sheet transporting amount applied to said transporting means.

16. A printer according to claim 1, wherein after the step 2), said control means causes said transporting means to transport the sheet from the upstream part to the downstream part, and causes said printing means to print said successively incoming data.

17. A printer according to claim 1, wherein said control means includes means for managing said imaginary line on the sheet in the terms of a logical position on the sheet as obtained based on an accumulative value of a sheet transporting amount applied to said transporting means.

18. A method of printing on an upstream-side portion of a sheet and applying a processing on a downstream-side portion of the sheet by using a printer including transporting means for transporting a sheet of paper from an upstream side to a downstream side, printing means for printing on the sheet, and processing means for applying a process on the sheet located downstream of the printing means, the method comprising the steps of:

starting printing on the upstream-side portion by the printing means; and applying the processing on the downstream-side portion by the processing means after starting printing, wherein, in the starting printing step and the applying processing step, the transporting means does not transport the sheet from the downstream side to the upstream side.

19. The method according to claim 18, further comprising the steps of:

stopping transporting of the sheet when a predetermined position to be processed on the sheet reaches a predetermined processing position of the processing means during the transporting of the sheet from the upstream side to the downstream side so that the printing means stops printing on the upstream-side portion of the sheet, wherein the applying processing step is executed after the stopping transporting step; and restarting printing on the upstream-side portion of the sheet without transporting the sheet paper from the downstream side to the upstream side.

20. The method according to claim 19, further comprising the steps of:

judging whether or not the predetermined position to be processed on the paper sheet will move beyond the predetermined processing position of the processing means when the sheet is transferred by a predetermined sheet feed amount in order to print, dividing the sheet feed amount into first and second sheet feed amounts so that the sheet stops at a position where the predetermined position to be processed reaches the processing position of the processing means when the predetermined position to be processed goes beyond the processing position; and transporting the sheet by the first sheet feed amount.

21. A printer comprising:

printing means for printing on the sheet, and processing means for applying a process on the sheet located downstream of the printing means, wherein, in order to print on an upstream-side portion of the sheet and apply the processing on a downstream-side portion of the sheet, the printing means starts printing on the upstream-side portion, and the processing means applies the processing on the downstream-side portion after the printing means starts printing without transporting the sheet from the downstream side to the upstream side.

22. The printer according to claim 21, wherein the transporting means stops transporting the sheet when a predetermined position to be processed on the paper sheet reaches a predetermined processing position of the processing means during the transporting of the sheet from the upstream side to the downstream side so that the printing means stops printing on the upstream-side portion of the sheet;

the processing means applies the processing after the transporting means stops transporting, and the printing means restarts printing on the upstream-side portion of the sheet without transporting the sheet paper from the downstream side to the upstream side.

23. The printer according to claim 22, wherein the printing by the printing means and the transporting by the transporting means are executed alternately to print on the upstream-side portion of the sheet.

24. The printer according to claim 22, further comprising:

judging means for judging whether or not the predetermined position to be processed on the paper sheet will move beyond the predetermined processing position of the processing means when the sheet is transferred by a predetermined sheet feed amount in order to print; and dividing means for dividing the sheet feed amount into first and second sheet feed amounts so that the sheet stops at a position where the predetermined position to be processed reaches the processing position of the processing means when the predetermined position to be processed goes beyond the processing position; and wherein the transporting means transports the sheet by the first sheet feed amount.

25. The printer according to claim 21, wherein the printing means executes printing in conjunction with the operation of the transporting means.

26. The printer according to claim 21, further comprising analysis means for analyzing print information including processing position data representing a position to be processed on the sheet and image data representing an image to be printed.

27. The printer according to claim 21, wherein the printing by the printing means and the processing by the processing means are performed concurrently.

28. The printer according to claim 21, wherein a clearance between the upstream-side portion and the downstream-side portion of the sheet is smaller than a clearance between a printing position of the printing means and a processing position of the processing means.

* * * * *